US012781502B1

(12) United States Patent
Non et al.

(10) Patent No.: US 12,781,502 B1
(45) Date of Patent: Nov. 3, 2026

(54) INTERLOCKING COVER ASSEMBLY FOR FLUID-TIGHTLY COVERING A TANK OR OTHER ENCLOSURE

(71) Applicant: Pleasant Mount Welding Inc., Carbondale, PA (US)

(72) Inventors: Robert Non, Carbondale, PA (US); Joe Dobosh, Carbondale, PA (US)

( * ) Notice: Subject to any disclaimer, the term of this patent is extended or adjusted under 35 U.S.C. 154(b) by 508 days.

(21) Appl. No.: 18/202,683

(22) Filed: May 26, 2023

Related U.S. Application Data

(60) Provisional application No. 63/346,712, filed on May 27, 2022.

(51) Int. Cl.
*E04B 7/16* (2006.01)
*E04B 7/00* (2006.01)

(52) U.S. Cl.
CPC ..... *E04B 7/163* (2013.01); *E04B 2103/06* (2013.01)

(58) Field of Classification Search
CPC ..... E04B 7/163; E04B 2103/06; E04B 7/166; E04B 5/10; E04B 1/24; E04B 1/3211; E04B 2/965; E04B 5/023; E04B 5/04; E04B 5/06; E04B 5/29; E04B 5/40; E04B 5/43; E04B 7/16
USPC ..... 52/19
See application file for complete search history.

(56) References Cited

U.S. PATENT DOCUMENTS 584,068 A * 6/1897 Weber ..... E04B 7/028 220/653
683,426 A * 10/1901 Balph ..... E04B 5/40 52/331
864,941 A * 9/1907 Wilson ..... E04B 7/166 52/66
1,318,995 A * 10/1919 Hartman ..... E04B 5/10 52/432
2,007,354 A * 7/1935 Vass ..... E04B 5/10 52/630

(Continued)

FOREIGN PATENT DOCUMENTS

CN 107178222 A * 9/2017 ..... E04H 1/12
EP 0178275 A2 * 4/1986 ..... E04F 15/02458

(Continued)

*Primary Examiner* — Anna M Momper
*Assistant Examiner* — Joseph J. Sadlon
(74) *Attorney, Agent, or Firm* — John Rizvi; John Rizvi, P.A. The Patent Professor®

(57) ABSTRACT

A cover assembly, mountable without welds, includes multiple panels attachable together by structural support beams. The panels may be openable for access, or non-openable. The cover assembly may include gas-tight sealings between the panels and the support beams, and for scaling the cover assembly to a tank or other enclosure on which the cover assembly is mounted. The panels may be formed from a series of edge-to-edge planks and other plank-like components. Standard male-female connections allow parts to slide together to form panels. Interlock edge members are attached to plank ends of a panel thereby creating a rigid panel. Panels are connected to support beams using sliding latches. The inventory of available components enables various type panels to be configured and covers may be either flush or top mounted to a tank. All panels are removable. The cover assembly may be constructed in a rectangular, circular or other shapes.

16 Claims, 21 Drawing Sheets

(56) References Cited

U.S. PATENT DOCUMENTS 2,211,513 A * 8/1940 Nagin ..... E01D 19/125 52/669
2,655,881 A * 10/1953 Lenke ..... E04B 7/18 52/308
2,887,192 A * 5/1959 Blaski ..... E04D 3/3605 52/506.1
3,088,559 A * 5/1963 Hannoosh ..... E04H 15/02 52/630
3,177,619 A * 4/1965 Benjamin ..... E04B 5/40 52/332
3,248,840 A * 5/1966 Petterson ..... E06B 3/5871 52/775
3,680,530 A * 8/1972 Drawsky ..... A01K 1/0151 119/529
3,710,526 A * 1/1973 Parks ..... E04B 5/32 52/223.6
3,738,083 A * 6/1973 Shimano ..... E04B 1/34315 52/584.1
3,813,179 A * 5/1974 Priest ..... E04B 1/24 411/401
3,906,694 A * 9/1975 Schubach ..... E04B 5/023 52/471
3,909,994 A * 10/1975 Richter ..... E04H 15/36 52/63
3,913,287 A * 10/1975 Chapman, Jr. ..... E04B 5/06 52/235
3,973,367 A * 8/1976 Johnson ..... E04B 7/02 52/92.1
4,070,805 A * 1/1978 Kastner ..... E04B 1/34315 52/270
4,073,113 A * 2/1978 Oudot ..... F16B 7/0486 403/189
4,102,108 A * 7/1978 Cody ..... E04B 1/24 52/693
4,335,557 A * 6/1982 Morton ..... E04B 1/164 52/250
4,342,177 A * 8/1982 Smith ..... E04C 3/40 403/387
4,400,922 A * 8/1983 Boyer ..... E04D 3/3607 52/529
4,486,998 A * 12/1984 Hague ..... E04D 3/3607 52/520
4,541,210 A * 9/1985 Cook ..... E04B 7/102 52/80.1
4,603,532 A * 8/1986 Watson ..... E04B 5/10 52/262
4,766,020 A * 8/1988 Ellingson, Jr. ..... E04F 19/10 52/177
5,056,286 A * 10/1991 Bokor ..... B07B 1/4645 52/507
5,069,009 A * 12/1991 Suzuki ..... E04B 1/35 52/81.3
5,251,415 A * 10/1993 Van Auken ..... E04D 12/00 52/407.4
5,412,915 A * 5/1995 Johnson ..... E01D 19/125 52/177
5,486,392 A * 1/1996 Green ..... A47L 23/26 52/177
5,511,345 A * 4/1996 Jones ..... E04C 2/20 52/630
5,632,123 A * 5/1997 Erwin ..... C23C 4/18 52/177
5,675,941 A * 10/1997 Dykmans ..... E04B 7/102 52/80.1
5,715,636 A * 2/1998 Taylor ..... E04C 2/54 428/428
5,732,512 A * 3/1998 Ueno ..... E02D 29/14 404/26
5,771,655 A * 6/1998 Strickland ..... E04B 5/10 52/654.1
5,788,406 A * 8/1998 Hernandez ..... E02D 29/1463 404/25
5,822,947 A * 10/1998 Tarrant ..... E04B 5/10 52/660
5,950,368 A 9/1999 Bradford
5,992,112 A * 11/1999 Josey ..... E04B 1/34347 52/309.8
5,997,210 A 12/1999 Shirakawa
6,116,813 A * 9/2000 Pate ..... E02D 29/14 137/364
6,260,322 B1 * 7/2001 Lindsay ..... E04B 5/48 52/650.1
6,301,854 B1 * 10/2001 Daudet ..... E04B 5/14 52/262
6,672,019 B1 * 1/2004 Wenz ..... E04H 6/10 52/174
6,722,813 B2 * 4/2004 Hauer ..... E02D 29/1427 137/364
6,887,012 B1 * 5/2005 Zappe ..... E02D 29/14 404/25
6,959,520 B2 * 11/2005 Hartman ..... F24S 25/632 52/838
7,028,446 B2 * 4/2006 Winchester ..... E04B 7/022 52/746.1
7,080,954 B2 * 7/2006 Monneret ..... E03F 5/06 404/25
7,178,290 B2 * 2/2007 Gowland ..... E02D 29/1427 49/463
7,347,070 B1 3/2008 Spector
7,451,575 B2 * 11/2008 Hall ..... F16B 9/052 248/200.1
7,726,902 B1 6/2010 Bongiovanni et al.
7,779,590 B2 * 8/2010 Hsu ..... E04B 5/40 52/328
7,779,599 B2 * 8/2010 Jolicoeur ..... E04G 1/34 52/651.1
7,849,648 B2 * 12/2010 Tonyan ..... E04B 5/10 428/192
8,353,131 B2 * 1/2013 Freet ..... E04D 3/40 52/645
8,375,676 B2 * 2/2013 Takakura ..... E04B 5/38 52/414
8,881,469 B1 * 11/2014 Meyer ..... E04D 13/1606 52/444
9,200,445 B2 * 12/2015 Leines ..... E04B 5/02
9,234,351 B1 * 1/2016 Echelman ..... B64G 1/10
9,352,249 B2 * 5/2016 Heap ..... B01D 19/0031
9,506,255 B1 * 11/2016 Jones ..... E01C 5/20
9,598,233 B2 * 3/2017 Harvey ..... B65D 88/34
9,611,646 B2 * 4/2017 Martin ..... E04C 2/38
9,677,301 B2 6/2017 Zeloof et al.
9,683,367 B1 * 6/2017 Ting ..... E04B 1/41
9,845,599 B2 * 12/2017 Bogh ..... E04B 5/40
9,874,018 B1 * 1/2018 Conklin ..... E06B 3/66304
9,970,193 B1 * 5/2018 Boxer ..... E02D 27/16
10,066,390 B2 * 9/2018 Pospisil ..... E04B 1/94
10,174,507 B1 * 1/2019 Henbid ..... A01G 9/1407
10,202,763 B2 * 2/2019 Hogan ..... E04B 2/965
10,294,627 B2 5/2019 Bechler et al.
10,465,396 B2 * 11/2019 Apostolopoulos ..... E04G 3/22
10,738,483 B1 * 8/2020 O'Keeffe ..... B32B 17/06
10,947,693 B2 3/2021 Dang et al.
11,066,803 B2 7/2021 Dang
11,313,122 B2 * 4/2022 Budd ..... E04B 2/90
11,326,337 B2 * 5/2022 Ohde ..... E04B 1/19
11,459,755 B2 * 10/2022 Strickland ..... E04B 5/40
11,891,802 B2 * 2/2024 Stretch ..... E02D 5/22
12,312,808 B2 * 5/2025 Coubray ..... E04B 5/04
2008/0053003 A1 * 3/2008 Hockemeyer ..... E04D 3/362 52/22
2016/0376804 A1 * 12/2016 Morta ..... E04B 1/08 52/19
2017/0022709 A1 * 1/2017 Vanker ..... E04B 5/40
2017/0159284 A1 * 6/2017 Getz ..... E04B 2/58
2020/0256048 A1 * 8/2020 Crowther ..... B65D 90/513
2021/0095466 A1 * 4/2021 Scott ..... E04B 5/04
2024/0287796 A1 * 8/2024 Fuller ..... E04B 5/10

(56) References Cited

U.S. PATENT DOCUMENTS

FOREIGN PATENT DOCUMENTS

| | | | | | |
|---|---|---|---|---|---|
| JP | 5572100 | B2 * | 8/2014 | ..... | E04B 5/10 |
| NL | 1004128 | C2 * | 3/1998 | ..... | E04B 5/04 |

* cited by examiner

INTERLOCKING COVER ASSEMBLY FOR FLUID-TIGHTLY COVERING A TANK OR OTHER ENCLOSURE

CROSS-REFERENCE TO RELATED APPLICATION

This application claims the benefit of U.S. Provisional Patent Application No. 63/346,712, filed on May 27, 2022, which is incorporated herein by reference in its entirety.

FIELD OF THE INVENTION

The present invention relates in general to a cover for a tank, and more particularly, to a modular interlocking cover assembly which may be shipped to a jobsite in panel and component form and assembled at the jobsite.

BACKGROUND OF THE INVENTION

There is an environmental necessity for covers configured to enclose in odorous materials, especially for above ground tanks which are used for storing waste materials including sewage, chemical sludge, petroleum products and the like, where such materials are typically stored for later disposal or process treatment. Such tank covers must be substantially gas tight for controlling odors in the vicinity of the tank structure and for trapping potentially hazardous gases inside the tank.

Tanks used for storing such waste materials may have a very long span or diameter, such as of fifty feet or more. Furthermore, it is generally necessary to support a tank cover only at the edges of the tank. Because of this, such tank covers must be capable of spanning a large distance and may even require a truss system to support the cover.

The aforementioned tank covers are generally too large to be conveniently or cost-effectively shipped in a fully assembled form from a manufacturer to a site where the tank cover will be utilized. Due to the tank cover's enormous size, the cover is generally shipped in panel and component form and assembled at the jobsite.

Conventional tank covers have been typically constructed of steel and consequently very heavy, and often extremely expensive to ship even in component form. Further, such covers have generally required welded connections as well as bolted connections to assemble. As such, skilled personnel have been required to carry out the final assembly of the cover, resulting in longer installation times and costs.

One conventional approach to large-span tank covers has been a geodesic dome type structure. This type of cover required highly skilled erecting labor and was excessively costly.

Accordingly, there is an established need for a solution to at least one of the aforementioned problems. For example, there is a significant need for a cost effective, site erectable, and substantially gas-tight tank cover which can be assembled quickly and with a minimum of welds and bolted connections. It is also desirable that such a cover is substantially and easily configurable, to allow for building covers in a wide range of shapes and sizes.

SUMMARY OF THE INVENTION

The present invention is designed to be a modular interlocking gas-tight cover assembly for a tank or other enclosure which may require spanning a long distance. The cover assembly is designed to be shipped as a component package (fully shop assembled panels and support beams and stiffening members) to a site where it will be used and erected. The cover assembly form is of flat panel construction that may be pitched or sloped for drainage purposes. The flat panel construct is configured to remain structurally sound and substantially gas-tight under repeated thermal cycling conditions.

The cover assembly may be constructed of modular components and panels. In some embodiments, the components and panels may be connected and interlocked together at the installation site without welds and with a limited number of bolted connections. Durable elastomeric seals between components of the cover assembly and between the cover assembly and tank may make the cover assembly substantially gas-tight. The construction design and gasket seals may allow the cover assembly to expand and contract under thermal cycling thereby absorbing thermal stresses to which the cover assembly may be subjected.

In one preferred embodiment, the cover assembly comprises a plurality of panels and a plurality of support beams. Each panel is formed by a multiplicity of extruded planks and other plank-type components connected to one another edge-to-edge. The panels are arranged side-by-side with adjacent panels and connected to one another by a support beam in one direction and by an overlap/underlap arrangement in the other direction. The ends of the support beam engages cover assembly support means that are attached directly to the tank.

Each panel includes two interlock edge members extending transversely along the two sides of the panel in the direction perpendicular to the plank spans. The interlock edge members are positioned over the plank ends and connected to the planks by rivets and adhesive to form a rigid panel. The panels and support beams have interconnecting means therein and use elastomeric gaskets for providing a substantially gas-tight seal between the panel and support beam.

Perimeter panels with a panel side engaging directly with the tank also include an elastomeric gasket for means of providing a substantially gas-tight seal between the panel and tank.

The support beams also include a sealing member which engages the cover assembly support means for providing a substantially gas-tight seal between the support beam and tank.

The panels may be generally rectangular, and the support beams configured to provide a flat panel cover assembly having a grid-like appearance. Alternatively, panels may be generally in the form of a combination of rectangular shapes for internal panels and perimeter panels that form a section of a circle with the support beams configured in a similar fashion to above to provide a cover assembly having a circular shape.

In another embodiment of the invention, a circular flat panel interlocking cover assembly for a tank is constructed from a plurality of panels, each generally in the shape of a segment of a circle and plurality of support beams arranged alternately in a radial or spoke-shaped pattern. Each panel includes a multiplicity of planks and components connected together edge-to-edge. Adjacent panels are connected together between adjacent pairs of radially positioned support beams.

The radial support beams are preferably each attached at one end thereof to a circular tank hub located near the center of the radial pattern. The other end of the radial member engages the outer wall of tank to attach to the tank structure.

In all of the embodiments described above, a preferred means for connecting a panel to a support beam includes an outwardly and downwardly facing hook extending along the interlock edge members of the panel, and an outwardly and upwardly facing hook extending along the cross support beam or radial support beam.

The downward facing hook of the interlock edge member is placed over the upward facing hook of the support beam for supporting the panel on the support beam or radial beam. The hooks are only a part of the interconnection arrangement for securing panels to the support beam. There is a small distance between hooks that allow for slight thermal movements between the panels and support beam.

To connect and secure panels to the crossing or radial support beam, a slide latch assembly is used. The slide latch assembly is retained inside the plank-like handle component of a panel and is able to travel between the guide nubs of the handle. The slide latch assembly slides toward a slot opening in the interlock edge member and continues through the interlock edge member slot into the retaining slot of the support beam. Once the latch is correctly positioned in the support beam or radial beam slot, a wing screw is tightened to hold the slide latch assembly in that location, thereby connecting and securing the panel to the support beam and preventing any uplift or inadvertent disconnection therefrom. Additionally, the latching process forces the panel downward tightly onto an elastomeric gasket positioned in the T-slot of the support beam, providing a substantially gas-tight seal between the panel and support beam.

A panel is preferably secured using four slide latch assemblies generally positioned near the four corners of the panel. It should also be noted that an adjacent panel may also provide two of the slide latch assembly locations when there is an overlap/underlap type connection between adjacent panels, thereby requiring a panel to have only two slide latch assemblies actually located on that panel. The slide latch assemblies may act in pairs, which may be located at opposite longitudinal ends of a plank of a panel (e.g., an interlock or overlap plank at a transverse edge of the panel).

A cover assembly is assembled of a plurality of modular panels that may include one or more hinged, openable access panels. At each hinged access panel a rigid, durable one-piece extruded hinge connects the panel with an adjacent fixed panel, through the width of the panels. The hinge allows the access panel to rotate open a full 180° onto an adjacent panel. The rotational area of the hinge is enclosed preventing debris from entering and impeding the operation of the hinged panel. Further, using the hinged access panel of the invention eliminates the need to assemble standard piano type hinges onto the panels with fasteners, thereby making on-site installation simpler and less costly. The hinge is an integral part of the cover assembly and is essentially flush mounted with the cover plank decking. The hinge of the present invention is substantially more durable and reliable than gear-type hinges of previous art and provides for a smoother operation, thereby eliminating the possibility of hinge jam due to debris being trapped in gear teeth and leading to hinge failure. The hinge may be placed anywhere in the cover assembly to convert a panel into an openable panel, thereby allowing access underneath the cover assembly to all required areas.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
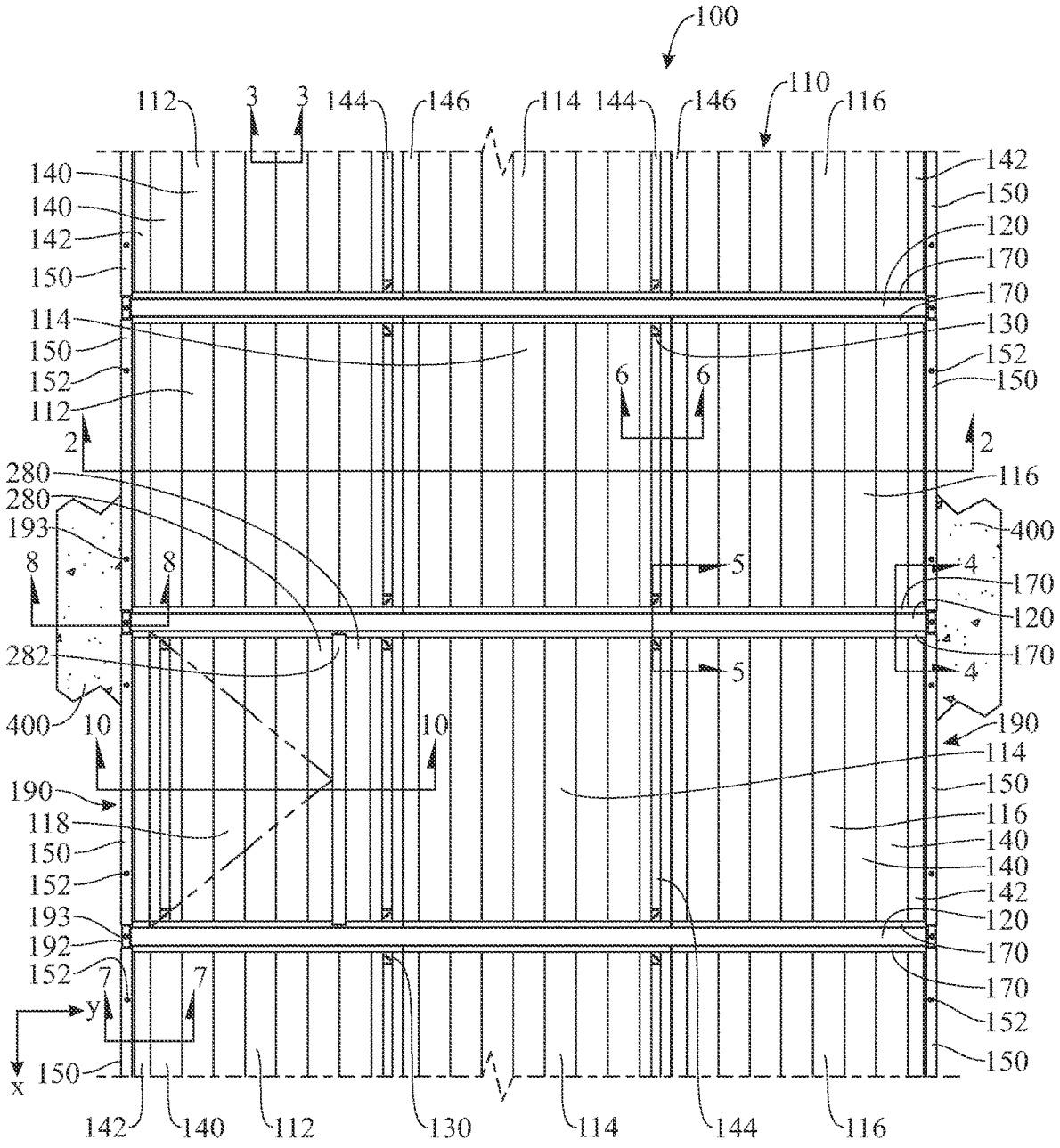
FIG. 1 presents a partial, top plan view of a rectangular cover assembly in accordance with a first illustrative embodiment of the present invention, the cover assembly mounted on a tank.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a cover assembly configured to gas-tightly cover a tank or other enclosure. The cover assembly may be modularly configured, and may be shippable to a jobsite in panel and component form and assembled at the jobsite in preferred embodiments. In some embodiments, the cover assembly components are constructed primarily from aluminum extrusions, although other materials may be used additionally or alternatively, such as, but not limited to, wood or steel. The different components and/or materials may be assembled using connection methods such as welds, screws, or bolts. In preferred embodiments, the cover of the present invention is field erectable, at the location at which it is used, without the need for personnel having specialized skills. In such embodiments, it is preferable that the cover is constructed of lightweight components (e.g., aluminum) and assembled preferably without welds and with a minimum of bolted connections.

In preferred embodiments, the cover is configured to be resistant to atmospheric corrosion and to corrosion by gases contained within a tank. Furthermore, in some embodiments, the cover is easily adaptable to conform to tanks in a range of different sizes and shapes, such as, but not limited to, generally rectangular or circular. In preferred embodiments, components of the invention, which will be described in detail below, make maximum use of lightweight parts that are readily extruded from aluminum.

Turning now to the drawings, FIG. 1 shows a partial fragmentary plan view of a cover assembly 100 in accordance with the principles of the present invention. The cover assembly 100 may extend generally along a longitudinal direction x and a transverse direction y, which are perpendicular to each other and to a vertical direction z, the x-y-z directions defining an orthogonal axis set. The cover assembly 100 of the present embodiment is generally rectangular and comprises a plurality of generally rectangular panels 110 arranged in a matrix or grid pattern (rows and columns along the longitudinal and transverse directions x and y, respectively). The plurality of panels 110 are connected to and generally carried by a plurality of support beams 120 to form the cover assembly over a tank 400 or other enclosure, hereinafter referred to generally as tank. In different embodiments, the plurality of panels 110 may include one or more non-access panels and/or one or more access panels, the access panel(s) configured to facilitate rapid and easy access to inside the tank or enclosure; for instance, the cover assembly 100 of the present embodiment includes non-access panels 112, 114, and 116, and a hinged access panel 118. The panels may be connected to adjacent support beams 120 using slide latch assemblies 130. Preferably four slide latch assemblies 130 are used to secure a panel to adjacent support beams 120. The seal between the panels 110 and support beams 120 may be achieved, for instance, by an elastomeric gasket located in the T-slots of support beam 120, as discussed in more detail hereinbelow.

In some embodiments, the panels 112, 114, 116 and 118 may be constructed, for instance and without limitation, from a plurality of full 6"-wide planks 140 and other plank-like components such as a 3" half width plank 142, an overlap plank 144, and an underlap plank 146. Some or all of said planks and plank-like components, and preferably all, may be formed by extrusion. Alternatively or additionally, some or all of said planks and plank-like components, and preferably all, may be formed as deck planks which are generally flat on a top side thereof, providing a stable top deck surface for walking, standing, and/or resting tools, machinery, equipment, etc. Additionally, miscellaneous components such as a perimeter mounting angle 150 are used on some panels such as panels 112, 116 and 118 that have a panel side mounting directly to the tank 400.

The deck planks 140 and plank-like components 144, 142, 146 are arranged edge-to-edge along the width of the cover assembly (i.e. along transverse direction y) to form the different panels. In accordance with the present disclosure, the deck planks and plank-like components may be interconnected by a standard or same-type male-female connection 160 (see FIGS. 3B and 3C) provided on the deck planks 140 and plank-like components, allowing to connect the different planks and plank-like components to each other as needed, thereby enhancing customization and ease of assembly. Components such as the overlap plank 144 and underlap plank 146 may have both a male and female version available that allow panels to be configured as required dependent upon the orientation of the standard male-female connections 160 on the deck planks 140 and other plank-like components in dependence of the number of deck plants that are used.

At opposite longitudinal ends of the planks 140 and plank-like components (i.e. opposite ends along the longitudinal direction x), respective interlock edge members 170 extend across all the planks 140 and plank-like component ends. In other words, the opposite longitudinal ends of each row of panels which extends along the transverse direction y, as shown in FIG. 1, is terminated in first and second interlock edge members 170 which extend in the transverse direction y and across the row. The transverse, interlock edge members 170 terminating opposite longitudinal ends of each row interconnect the panels of the row to each other and to an adjacent support beam 120. Each interlock edge member 170 may have a C-shaped profile or side 172 defining a channel 174 (see FIG. 4) on one side of the interlock edge member 170, the channel 174 receiving all plank and plank-like component ends such that the C-shaped side 172 encloses said plank and plank-like component ends. The plank and plank-like component ends are attached to the interlock edge member 170 using rivets and adhesive to form a rigid structure. The C-shaped side 172 of the interlock edge member 170 provides the means such that the planks 140 and other plank-like components may be supported by the interlock edge member 170 solely at their ends. In some embodiments, the interlock edge members 170 may be formed by extrusion.

The support beams 120 of the present embodiment are formed as cross beams extending transversely and in spaced-apart relationship across the cover assembly 100. The support beams 120 may be parallel, as shown. The support beams 120 are preferably preformed such that the planks 140 and other edge-to-edge components are retained entirely at their ends by the interlock edge members 170, which in turn are supported by the support beams 120 and secured with the slide latch assemblies 130. The weight of the assembled cover assembly 100 may be supported entirely by the support beams 120 and, in some embodiments, by structural, support or stiffening members 180, shown for instance in FIGS. 8 and 20 and hereinafter referred to generally as stiffening members 180, which may be located below and attached to support beams 120. The rigidity of the panels of the present embodiment is at least partially, and preferably generally entirely, due to the connection of the planks 140 and other plank components to the interlock edge members 170.

As mentioned heretofore, edge-to-edge planks 140 and plank components, such as the overlap plank 144, may be interconnected by standard male-female connection 160. In some preferred embodiments, the male-female connection 160 may be configured with a sufficient tolerance to offer a slight degree of flexibility for panels to assume the form of a slight upward arc, thereby providing a positive means for drainage of covers. In embodiments provided with such flexibility of panels, chemically-resistant elastomeric gaskets may be incorporated to provide a substantially gas-tight seal. The elastomeric gaskets used in the present invention can conform to these potential shape changes to maintain a gas-tight seal between panels 112, 114, 116 and 118 and the respective support beams 120 and between perimeter panels 112, 116 and 118 and tank 400. Another advantage of a having flexible panels is that the flexible panels are capable of absorbing small changes in cover shape which may be imposed by environmental factors such as wind loads or thermal expansion.

Figure 2:
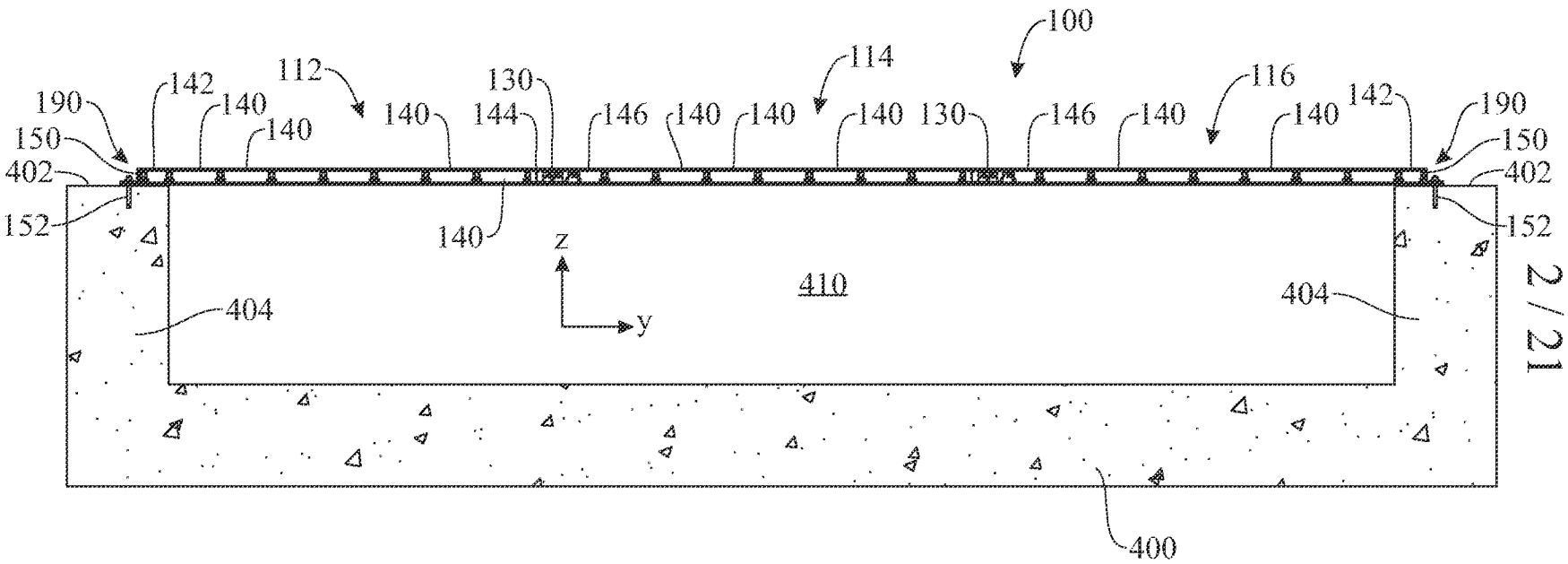
FIG. 2 presents a cross-sectional elevation view, in accordance with section plane 2-2 of FIG. 1, illustrating multiple panels spanning across a width of the tank and connected to opposite walls of the tank.

Turning to FIG. 2, as shown, the cover assembly 100 of the present embodiment has a generally flat, panel-type construction or configuration, provided by the adjacent and interconnected panels. The depicted cross-sectional view specifically shows interconnected panels 112, 114 and 116. The cover assembly 100 is supported on the tank 400 by a top mount support arrangement 190 attached to a top surface 402 of a wall 404 of the tank 400. As shown, the generally flat, cover assembly 100, formed mainly by the plurality of panels 110, extends over the tank 400 and may fluid-tightly enclose an interior space 410 of the tank 400.

As shown and described heretofore, the plurality of panels 110 of the present embodiment, such as the panels 112, 114 and 116 shown in the figure, are comprised primarily of the full-width planks 140, with the remainder of each panel generally consisting of other components such as the half width plank 142, overlap plank 144, and underlap plank 146. One advantage of the present invention is that panels may be configured to a specific size to meet a tank's geometry and panel weight limitations. It is preferable to construct a specific panel size to meet the maximum panel weight requirements, which in some cases may be about 150 pounds, thereby allowing personnel to lift panels safely without risk of injury. The illustration of FIG. 2 demonstrates how the present invention allows multiple panels 112, 114 and 116 to be constructed to the same approximate dimensions but using different component combinations to assemble the panels.

As mentioned above, when installing the cover assembly 100, some specific components may be selected based on the orientation of the standard male-female connection 160 available for mounting said specific components. For example, if a number of planks 140 are connected edge-to-edge in series and the last plank in the series is connected to the second last adjacent plank using the male protrusions side of the last plank, then the female receivers' side of the last plank will require the next component added, such as the overlap plank 144, to be a male version of the overlap plank 144 to mate successfully with the last plank in the series. As mentioned heretofore, plank-like components such as, but not limited to, the overlap plank 144 and underlap plank 146, may be provided in male and female versions to allow the mounting of either version as needed.

Figure 3A:
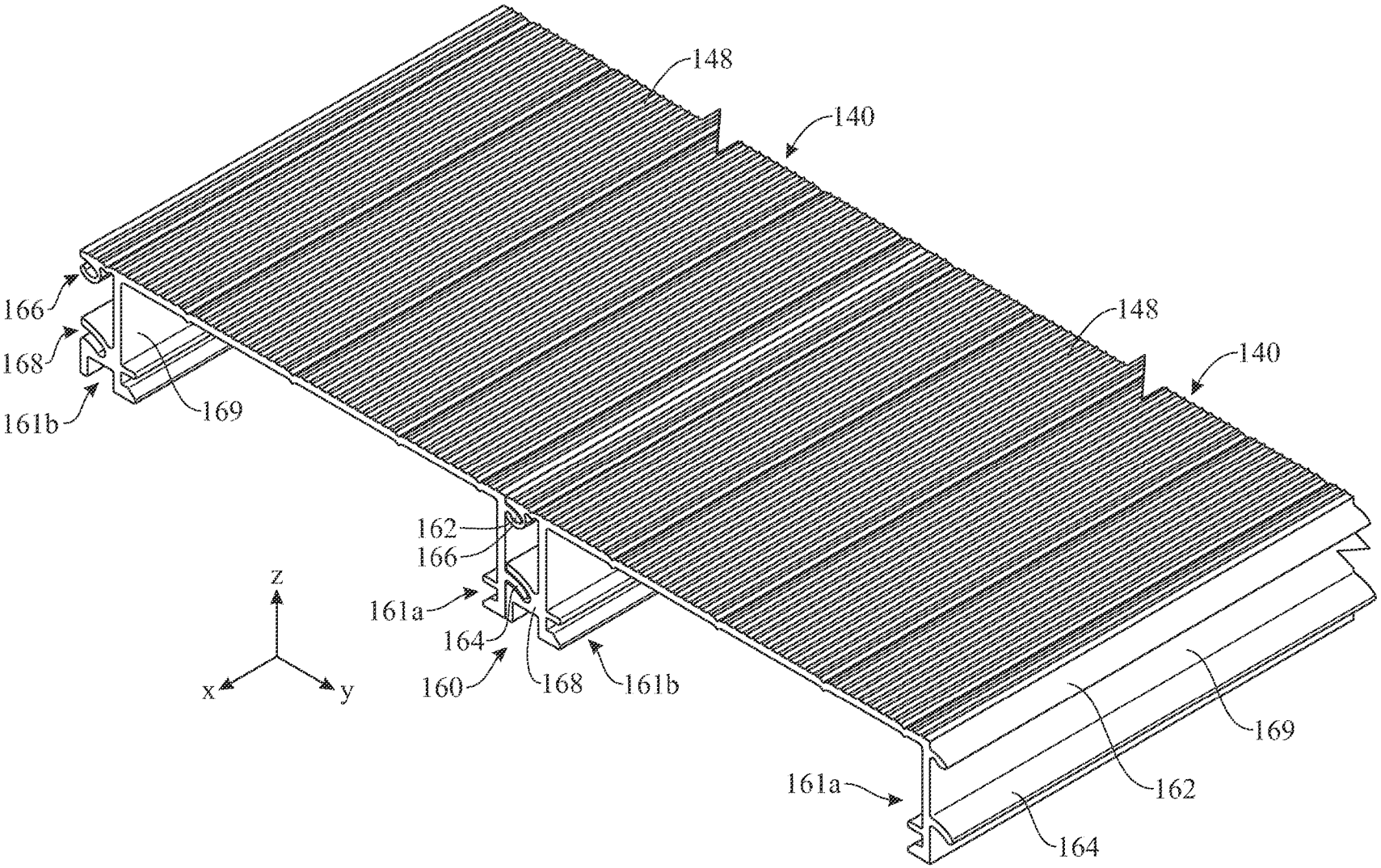
FIG. 3A presents a top isometric view of two connected planks comprised in the cover assembly.
Figure 3B:
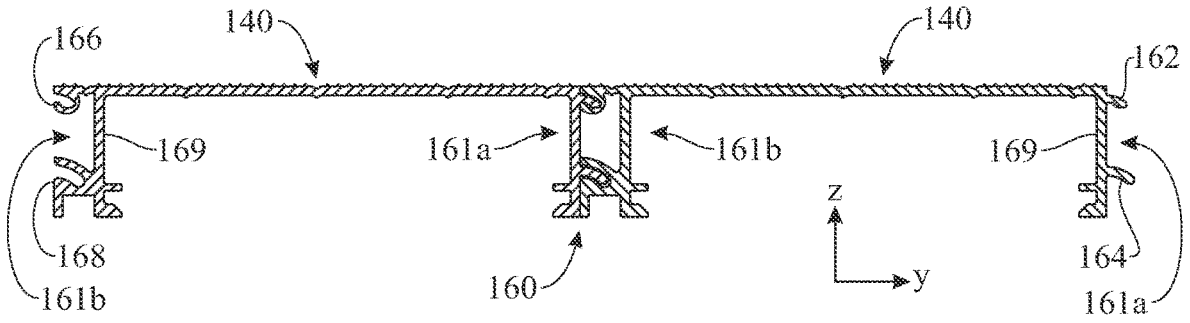
FIG. 3B presents a cross-sectional, front elevation view of the planks of FIG. 3A.
Figure 3C:
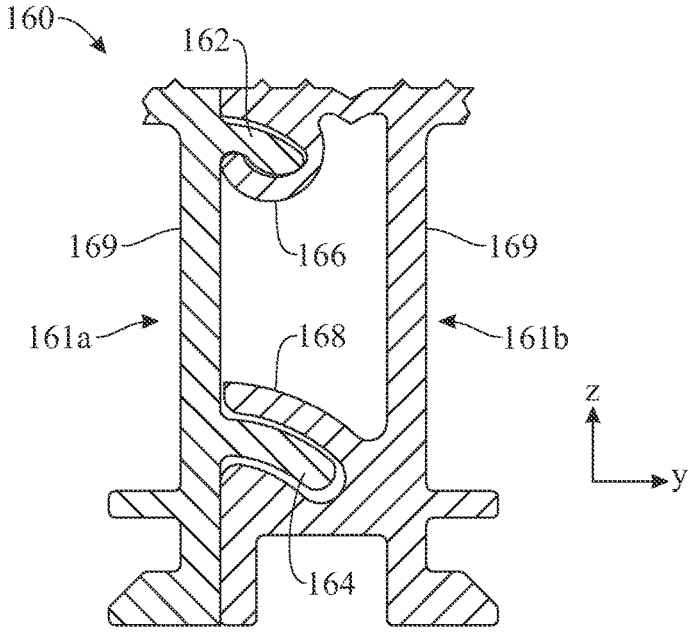
FIG. 3C presents an enlarged, cross-sectional front elevation view of the standard male-female connection arrangement shown in FIGS. 3A and 3B, which is used for connecting planks and other cover components.

The illustrations of FIGS. 3A-3C show two planks 140 interconnected by the standard male-female connection 160 in accordance with the present disclosure. As best shown in FIG. 3A and also shown in FIG. 1, the planks 140 are elongately formed in the longitudinal direction x. The male-female connection 160 may also be elongately formed along the longitudinal direction x. As further shown in FIGS. 3A and 3B, and better shown in the enlarged view of FIG. 3C, each male-female connection 160 is formed by a top and bottom male protrusion 162 and 164, respectively, which are carried by one component, and a top and bottom female receiver 166 and 168, respectively; the top and bottom male protrusions 162 and 164 are configured to mate with the top and bottom female receivers 166 and 168, respectively, thereby connecting the two components to one another. For instance, in the depicted example, the two planks 140 are interconnected by a coupling of the top and bottom male protrusions 162 and 164 carried by the left side plank 140 to the top and bottom female receivers 166 and 168 carried by the right side plank 140. As shown, the top and bottom male protrusions 162 and 164 may be comprised in an elongated, first connection member 161*a*, and the top and bottom female receivers may be comprised in an elongated, second connection member 161*b*. The first connection member 161*a* may include a vertically downward extending, elongated stiffening wall 169 carrying the top and bottom male protrusions 162 and 164. The second connection member 161*b* may include a vertically downward extending, elongated stiffening wall 169 carrying the top and bottom female receivers 166 and 168. The stiffening walls 169 may provide added rigidity to the plank 140. In some embodiments, as shown, the stiffening walls 169 of the first and second connection members 161*a* and 161*b* are generally parallel to one another and arranged in the longitudinal direction x. The first and/or second connection members 161*a* and 161*b*, and preferably both connection members 161*a* and 161*b*, may be integrally formed with (e.g., extruded) with the plank 140. For example, in the present embodiment, each one of the planks 140 includes a first connection member 161*a* and a second connection member 161*b* on opposite sides of the plank 140, with both connection members 161*a* and 161*b* integrally formed with the plank 140 (such as by aluminum extrusion). The standard male-female connection 160 (shown enlarged in FIG. 3C) is defined as the connection between the male protrusions 162 and 164 and the female receivers 166 and 168. It should be noted that the number and shape of male and female protrusions may vary in different embodiments, without departing from the scope of the present disclosure. The standard male-female connection 160 of the present disclosure provides a universal connection arrangement within the cover assembly 100 that is utilized between many of the components of the cover assembly 100, thereby easily allowing a wide variety of panel configurations to be assembled.

With continued reference to FIGS. 3A-3C, the planks 140 are preferably formed from extruded aluminum. The planks 140 may include a flat, or deck portion 148. When multiple planks 140 are mounted and attached to one another in side-by-side relationship as was heretofore described with reference to FIG. 1, the multiple deck portions 148 jointly provide a generally horizontal walking surface of the cover assembly 100 on which a user may walk or stand, and/or equipment and other items may be placed. As best seen in FIG. 3C, the standard male-female connection 160, and more particularly, the male-female fitting between the top and bottom male protrusions 162 and 164 and the top and bottom female receivers 166 and 168, respectively, is oriented downward and configured such that the male-female connection is enhanced when a downward force (caused, for instance, by a user or item's weight) is exerted on the walking surface provided by the multiple deck portions 148. In a further advantage, the male-female connections 160 are carried out by a simple sliding of the male protrusions 162 and 164 into and along the length of both female receivers 166 and 168 (see FIG. 3C), preferably without welds. In preferred embodiments, male protrusions 162 and 164 and female receivers 166 and 168 provide a close tolerance slide fit, providing a substantially gas-tight connection between the planks 140, while still providing a joint with some flexibility that a multiplicity of the planks forming a panel is free to assume a slightly curved form if necessary. Furthermore, due to the arced shape of the male protrusions 162 and 164 and the female receivers 166 and 168, once the male protrusions 162 and 164 are engaged into the female receivers 166 and 168, the planks 140 are unable to be pulled apart, i.e. separated by a pulling force exerted in the transverse direction y.

Figure 4:
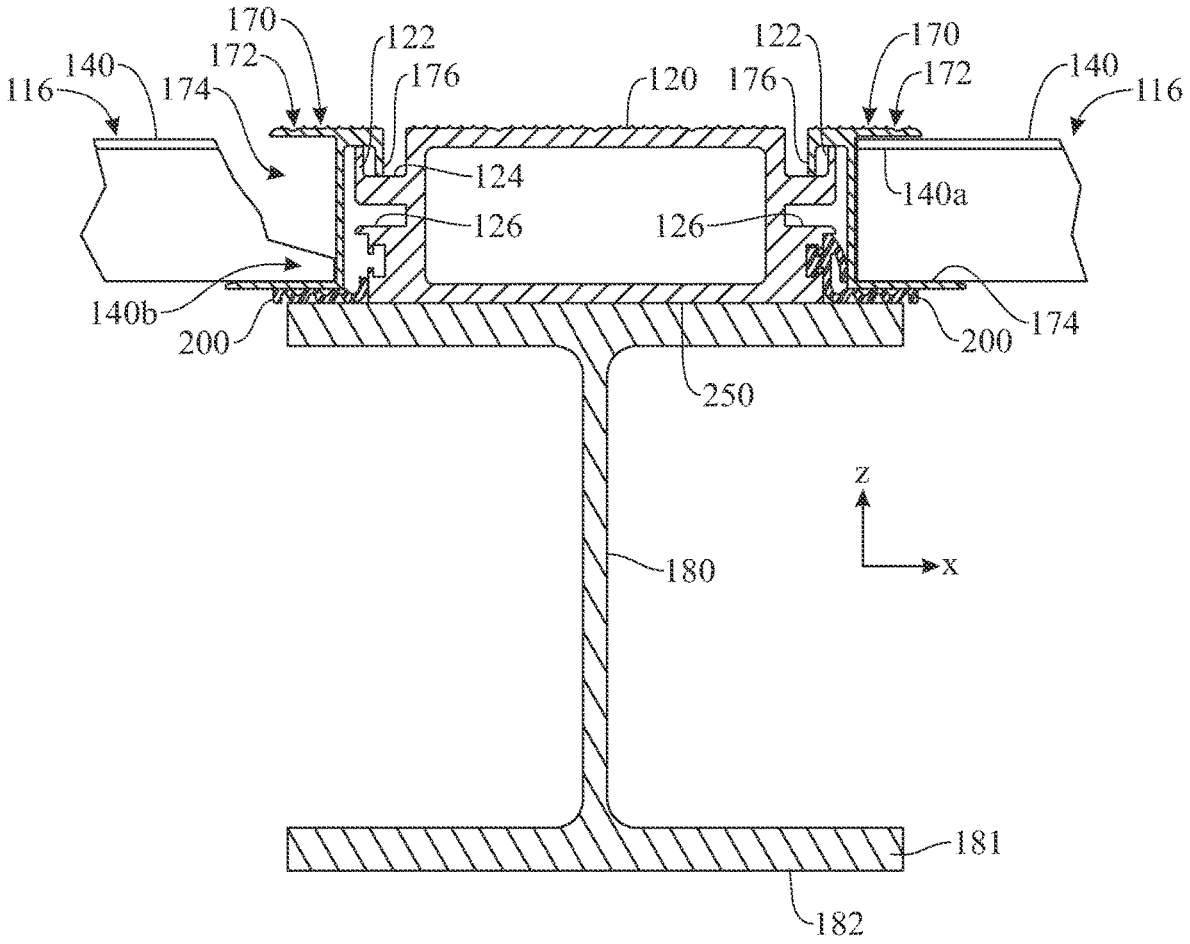
FIG. 4 presents a cross-sectional elevation view, in accordance with section plane 4-4 of FIG. 1, illustrating an interconnecting arrangement for panels and support beams of the cover assembly of FIG. 1.
Figure 5:
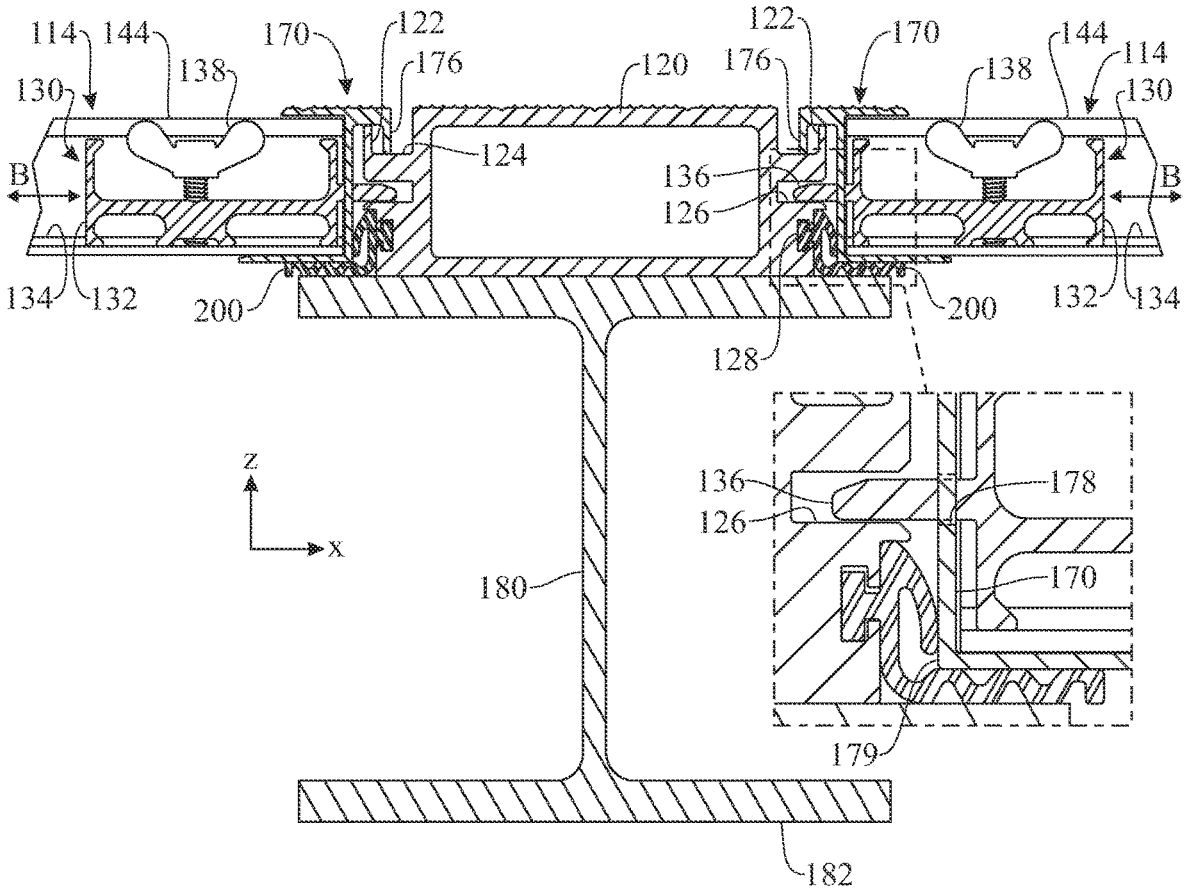
FIG. 5 presents a cross-sectional elevation view, in accordance with section plane 5-5 of FIG. 1, illustrating the slide latch assembly used to hold-down and secure panels to support beams of the cover assembly of FIG. 1.

The illustrations of FIGS. 4 and 5 show cross-section views of a preferred form of support beam 120 and interlock edge members 170 as seen, respectively, along section planes 4-4 and 5-5 indicated in FIG. 1. In the present embodiment, the support beam 120, preferably formed from extruded aluminum, includes on each side thereof, an outwardly and upward facing hook 122. The interlock edge members 170, which interconnect the panels 114, 116 as described heretofore, include an outwardly and downwardly facing hook 176. For placement of a panel, such as panel 116 shown in FIG. 4, onto the support beam 120, the downward facing hook 176 of interlock edge member 170 is set down onto the horizontal surface just inside of the upward facing hook 122 of the support beam 120. The downward facing hook 176 of interlock edge member 170 is preferably positioned at about the halfway location on the horizontal surface of support beam 120 as shown to allow for thermal movement in the longitudinal direction x and the transverse direction y.

With continued reference to FIGS. 4 and 5, the downward facing hook 176 of interlock edge member 170 may rest on the upward facing hook 122 of the support beam 120 and/or on a horizontal surface 124 of the support beam 120, and preferably on both the upward facing hook 122 and horizontal surface 124, such that the weight of the panel 114, 116 is supported by support beam 120 located on each end of panel 116. In addition to the support beam 120 supporting the weight of the panel 116, the panel 116 is secured to the support beam 120, as will be discussed in more detail hereinbelow.

Figure 6:
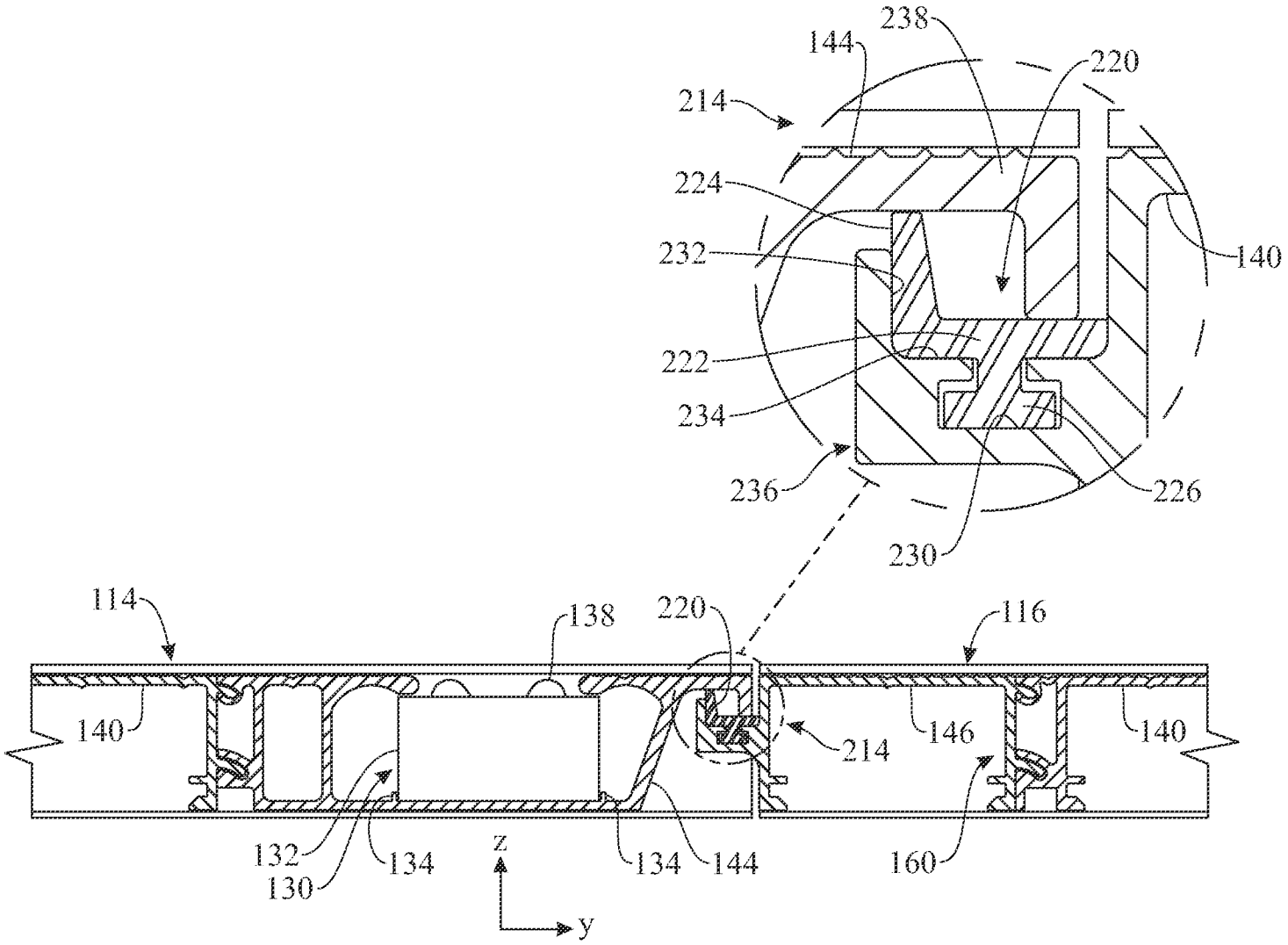
FIG. 6 presents a cross-sectional elevation view, in accordance with section plane 6-6 of FIG. 1, illustrating the slide latch assembly located in the overlap plank of the cover assembly of FIG. 1.

With reference now to FIGS. 5 and 6, details of the slide latch assembly 130, which connects and secure the internal panels 114 (i.e. panels not at the edges of the cover assembly 100) to the support beam 120, are shown. The slide latch assembly 130 comprises a main body 132, which may be formed from extruded aluminum, for instance and without limitation. A latch portion 136 is carried by and jointly slidable with the main body 132. The main body 132 is retained inside the overlap plank 144 of panel 114 and is able to slide in the longitudinal direction x and along the overlap plank 144, as indicated by arrow B in FIG. 5, between a pair of longitudinal guide nubs 134 provided in and along the overlap plank 144. Continuing with FIGS. 4, 5 and 6, the slide latch assembly 130 is slid toward a slot opening 178 formed in a vertical wall 179 of the interlock edge member 170 and the latch portion 136 of the slide latch assembly 130 continues through the slot opening 178 of the interlock edge member 170 into a retaining slot 126 formed in the support beam 120. Once the latch portion 136 of slide latch assembly 130 is correctly positioned and snug in the retaining slot 126, a wing screw 138 is tightened against a floor or bottom wall of the overlap plank 144 to immobilize the main body 132 in place relative to the overlap plank 144, and thereby retain the slide latch assembly 130 in a locked configuration in which the slide latch assembly 130 connects and secures the panel 114 to the support beam 120 and prevents any uplift or inadvertent disconnection therefrom.

Figure 12A:
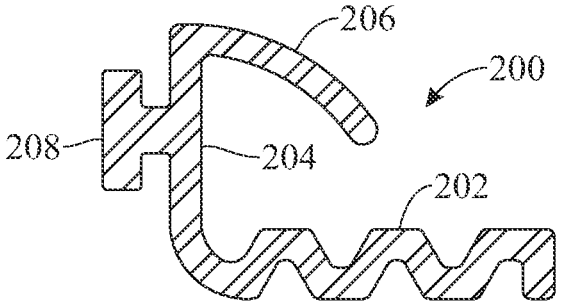
FIG. 12A presents an enlarged, cross-sectional elevation view of a sealing gasket used between the interlock edge member and support beam/stiffening support member.

With reference to FIG. 5, when the slide latch assembly 130 latches onto support beam 120 via the interlock edge member 170, the latching process forces the panel 114 downward tightly onto an elastomeric sealing gasket 200. As better shown in the enlarged view of FIG. 12A, the sealing gasket 200 comprises a generally horizontal, bottom corrugated section 202, a generally vertical side portion 204, a flap 206 extending from a top end of the generally vertical side portion 204 towards the bottom corrugated section 202, and a T-stem 208 extending outward from the generally vertical side portion 204 oppositely to the bottom corrugated section 202. Turning back to FIG. 5, when the latching process forces the panel 114 downward onto the sealing gasket 200, the T-stem 208 of the sealing gasket 200 is positioned into a T-slot 128 of the support beam 120 and, as the panel 114 is forced downward, the bottom corrugated section 202 of the sealing gasket 200 is compressed providing a substantially gas-tight seal between the panel 114 and the stiffening member 180 located below and attached to support beam 120. Further, as the sealing gasket 200 is compressed, the flap 206 of the sealing gasket 200 is forced against the vertical wall 179 of the interlock edge member 170 creating a second sealing point.

Figure 12B:
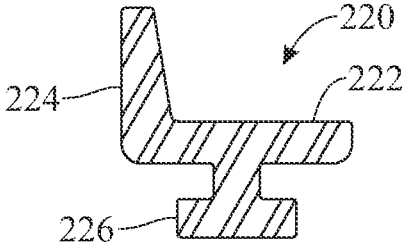
FIG. 12B presents an enlarged, cross-sectional elevation view of a sealing gasket used between panels at the overlap plank and the underlap plank interface.

Attention is now directed to FIG. 6, which shows the area where adjacent panels 114 and 116 longitudinally interface. As shown, along said area where the panels longitudinally interface, a standard overlap/underlap arrangement or connection 214 exists. The overlap/underlap connection 214 comprises a panel-to-panel sealing gasket 220, which maintains a gas-tight seal as both panels 114 and 116 are exposed to thermal movement or other environmental stresses. As better shown in the enlarged view of FIG. 12B, the panel-to-panel sealing gasket 220 includes a generally horizontal bottom portion 222, a generally vertical side portion 224 extending from the bottom portion 222, and a T-stem 226 extending downward from an underside of the bottom portion 222. As shown in FIG. 6, when the overlap/underlap connection/214 is carried out, the T-stem 226 is inserted into a T-slot 230 formed in the underlap plank 146. The side portion 224 and the bottom portion 222 of the sealing gasket 220 are nested against inner surfaces 232 and 234 of an upwardly directed hook 236 formed in the underlap plank 146. A downwardly oriented hook 238 of the overlap plank 144 engages with the upwardly directed hook 236 of the underlap plank 146 with slight freedom of movement in the transverse direction y, as shown, to accommodate thermal movements between the panels 114 and 116. The downwardly oriented hook 238 of the overlap plank 144 may rest on a top surface of the bottom portion 222 of the sealing gasket 220 and may be able to travel along said top surface of the bottom portion 222, further accommodating thermal movements between panels 114 and 116. As noted hereinabove, such accommodations of thermal movements contribute to maintaining a gas-tight seal between the panels.

With reference to FIGS. 1 and 6, a panel is preferably secured using at least one slide latch assembly 130, and more preferably, at least two slide assemblies 130 located on opposite longitudinal ends of the panel. For all intermediate panels (i.e. those panels that do not rest on the walls 404 of the tank 400), there may be four slide latch assemblies 130 generally positioned at or near the four corners of the panel, respectively. For example, in the case of panel 116 shown in FIG. 6, the two slide latch assemblies 130 securing the panel 116 in place are actually provided in the panel 114 yet near the edge or corners of the panel 116, such that the two slide latch assemblies 130 secure not only the intermediate panel 114 but also the edge panel 116 in place. I.e., the panel 116 itself does not include any slide latch assemblies 130 to secure the panel 116 in place; instead, the panel is secured using the two slide latch assemblies 130 of panel 114 while the other end of panel 116 is secured to the tank 400 (via the perimeter mounting angle 150) as shown in FIGS. 1 and 2. Details for providing a cover support means will be discussed in later paragraphs.

With continued reference to FIGS. 1 and 6, the two slide latch assemblies 130 located in the overlap plank 144 of the panel 114 secure two respective corners of the panel 114. Additionally, the overlap of the downward hook 238 of the overlap plank 144 of panel 114 is used to retain the upward hook 236 of the underlap plank 146 located on the panel 116. This overlap/underlap arrangement between adjacent panels 114, 116 (and also used in other panel interfaces) is used to secure two panels simultaneously and reduces the overall number of slide latch assemblies 130 comprised in the cover assembly 100. The slide latch assemblies 130 are preferably provided in pairs, and more preferably including two slide latch assemblies 130 per overlap plank 144.

Referring to FIG. 4, the C-shaped side 172 and channel 174 of the interlock edge member 170 are shown in detail. As described heretofore, the channel 174 is configured to receive a longitudinal end of the planks and plank-like components. For example, the channel 174 may receive the ends 140*a* and 140*b* of the planks 140 respectively comprised in the two adjacent panels 116. The channel dimensions of interlock edge member 170 are preferably based on a tight tolerance that provides a substantially gas-tight fit between planks 140 and interlock edge members 170. The same condition for fit preferably applies between the interlock edge member 170 and other plank-like components such as the overlap plank 144.

As described hereinabove, the planks 140 are designed such that one extrusion section is applicable to covers having different spans. It is also preferable to standardize the dimensions for interlock edge members 170 and support beams 120 such that they are usable in a wide range of cover sizes. Since the interlock edge member 170 preferably does not bear a structural load, the interlock edge member 170 may be of only one form for various cover sizes, thereby contributing to reduce cost and to simplify manufacture and logistics. The support beam 120, instead, may bear a significant structural load, which will increase as the size and span of the cover assembly increases.

With continued reference to FIGS. 4 and 5, in some embodiments, the size of the support beam 120 may be standardized (i.e. preset to a single, common size which may be used in different cover assembly 100 installations) by having the support beam 120 dimensioned such that the support beam 120, alone, may support a required minimum span. Then, for larger spans, the cover assembly 100 may be fitted with one or more of the aforementioned stiffening member or members 180, such as at a bottom surface 250 of the support beam 120, to provide the necessary rigidity for such larger spans.

In some preferred embodiments, the elongated support beam 120 may have an overall width of about 4 inches and an overall depth of about 2 inches. As shown in FIGS. 4 and 5, in some embodiments, the stiffening member 180 may be a readily available standard structural shape such as a wide flange beam, preferably of aluminum. The size and type of stiffening member 180 may be determined by the specific span and loading conditions that must be met. A structural tube or channel may also be used as a stiffening member 180 if required. For stronger stiffening requirements, stiffening members 180 may be stacked to create deeper section members. Stacked arrangements may be made, for instance, by adding additional members to an underside or bottom surface 182 of a bottom flange 181 of the stiffening member 180. In some embodiments, top mounted trusses may be used to support the weight of a cover assembly, such as when space above the liquid level of the tank 400 is insufficient to accommodate a stacked arrangement of stiffening members 180 without submerging the stiffening members 180.

Figure 7:
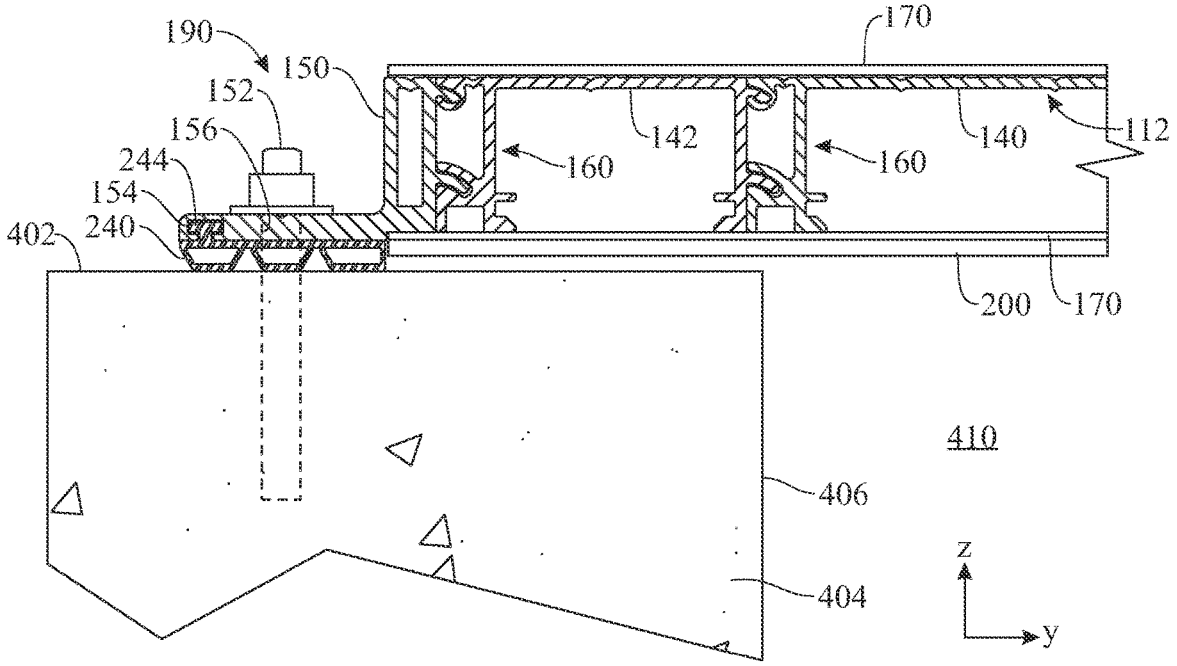
FIG. 7 presents a cross-sectional elevation view of a panel edge, in accordance with section plane 7-7 of FIG. 1, illustrating one embodiment of a mounting and sealing arrangement of the cover assembly of FIG. 1.

Attention is now directed to FIG. 7, which shows an illustrative embodiment of a cover support arrangement for supporting cover assembly 100 on the tank. 400 of FIG. 1. Specifically, the illustration of FIG. 7 shows details of the top mount support arrangement 190 (mentioned heretofore with reference to FIG. 2) for supporting the cover on the top surface 402 of the wall 404 of the tank 400. The top mount support arrangement 190 includes the male perimeter mounting angles 150 extending along the length of the tank 400 and attached thereto at intervals by mounting anchors or fasteners 152. It should be noted that, although not shown in FIG. 7, perimeter mounting angles 150 may be preferably provided on each of the two opposite sides of the tank 400 (see FIGS. 1 and 2). The perimeter mounting angles 150 may be located on one side each of perimeter panels 112, 116 and 118. As best shown in FIG. 1, the perimeter mounting angles 150 of the present embodiment do not run continuously along the wall 404 of the tank 400, but are interrupted at each location where the support beams 120 are supported on the wall 404 of tank 400 between adjacent panels (said location shown in FIG. 8).

Figure 12C:
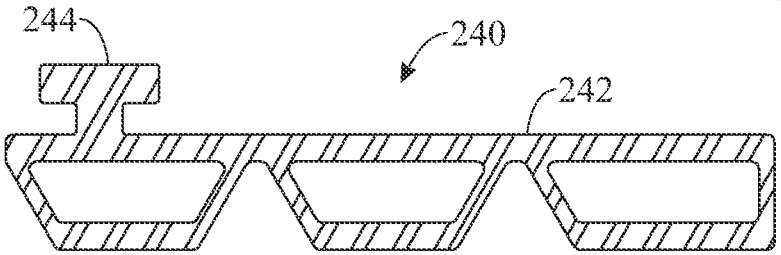
FIG. 12C presents an enlarged, cross-sectional elevation view of a perimeter sealing gasket used between the panels and the tank structure.

With continued reference to FIG. 7, the perimeter mounting angle 150 may be attached to the panel 112 (e.g., to a half-width plank 142 terminating the panel 112) and, as mentioned heretofore, may secure the panel 112 to the wall 404 of the tank 400 via the mounting fasteners 152. In some embodiments, the mounting fasteners 152 and perimeter mounting angle 150 are configured such that, in order to remove the panel 112, the mounting fasteners 152 must be unbolted, thereby increasing safety and durability of the installation. A perimeter sealing gasket 240 provides a gas-tight seal between panel 112 and the top surface 402 of the wall 404 of the tank 400. As best shown in FIG. 12C, the perimeter sealing gasket 240 includes a generally horizontal bottom portion 242 and a T-stem 244 extending upward from the generally horizontal bottom portion 242. When installed in place, as shown in FIG. 7, the perimeter sealing gasket 240 may be positioned below the perimeter mounting angle 150 and held in place by inserting the T-stem 244 of the sealing gasket 240 into a T-slot 154 formed in the mounting angle 150. The sealing gasket 240 may elastically abut against the sealing gaskets 200 (FIG. 5) located on each of the support beams 120 that run along the support beams 120 and two sides of the panel 112. The elongated, sealing gaskets 200 run along transverse direction y and thus perpendicular to the longitudinal direction x of the elongated, perimeter mounting angle 150, thereby creating a substantially gas-tight seal at the two outside corners of the panel 112. Both sealing gaskets 200 and 240 are made of an elastomeric material. In a non-limiting example, such elastomeric material may be Santoprene®, available from Exxon Mobil Chemical of Spring, Texas, USA; such a material is very resilient and can conform to surrounding objects thereby providing an effective seal at the contact surfaces.

As further shown in FIG. 7, the mounting fasteners 152 are inserted through discrete, spaced-apart holes, short slots or other similar openings 156 formed in the perimeter mounting angles 150. In some preferred embodiments, one side of the tank 400 may be provided with perimeter mounting angles 150 with holes on the fixed end side while the perimeter mounting angles 150 located on the opposite wall of the tank 400 may use a sliding arrangement to accommodate thermal growth of the cover assembly 100. In addition to the sliding arrangement of the supports, panel flexibility due to the edge-to-edge plank construction and movement allowances at panel-to-panel interfaces assist in absorbing changes in cover assembly shape due to thermal cycling or other environmental loading.

Figure 8:
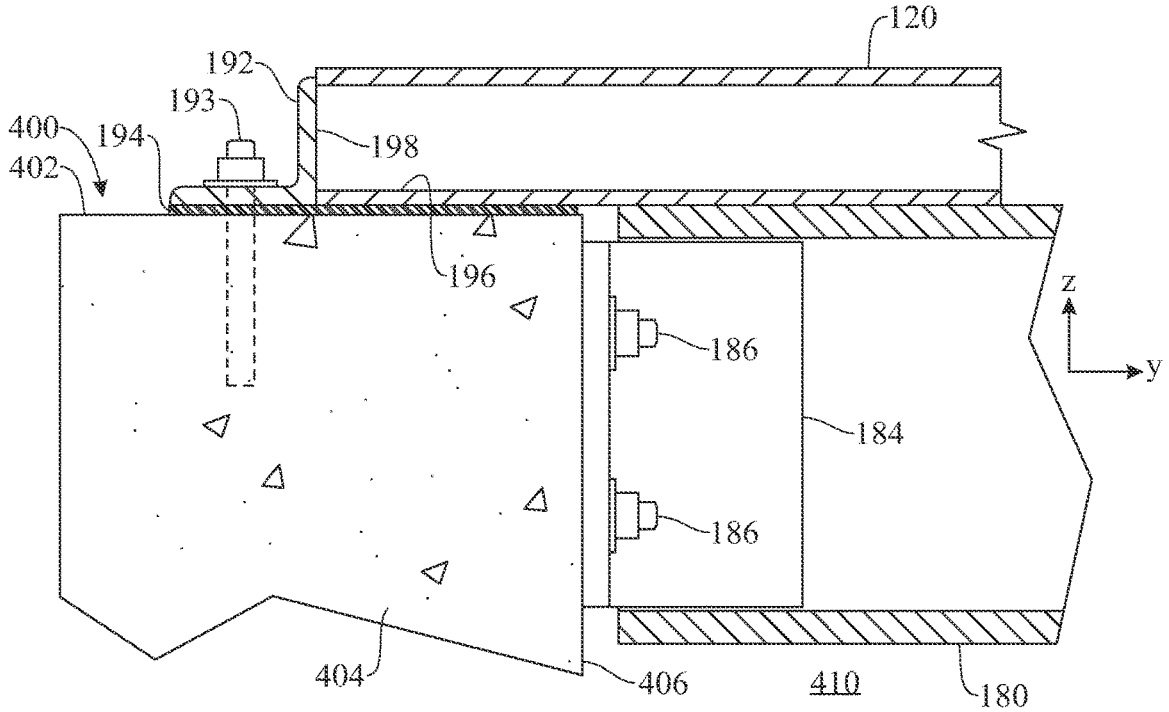
FIG. 8 presents a cross-sectional elevation view of the support beam, in accordance with section plane 8-8 of FIG. 1, illustrating the cover support arrangement of cover assembly of FIG. 1.

Attention is now directed to FIG. 8, which illustrates the attachment of the support beam 120 to the top surface 402 of wall 404 of the tank 400 in accordance with one embodiment of the invention. It should be noted that, while the figure shows one end of the support beam 120, a same attachment may be used at the opposite end of the support beam 120. Preferably, the ends of the support beam 120 include a means for providing a sliding engagement with the horizontal top surface 402 of the wall 404 of the tank 400. In the embodiment shown in the figure, the sliding action is accomplished by attaching an end cap angle 192 to the end of the support beam 120 and securing the end cap angle 192 to the wall 404 using a mounting fastener 193, the end cap angle 192 interconnecting the support beam 120 to the top surface 402. Located below the end cap angle 192 and partially below the support beam 120 sits a bearing pad 194; the bearing pad 194 may be generally rigid, such as constructed from aluminum. The bearing pad 194 may be topped with a slide surface 196, made for instance of UHMW (Ultra High Molecular Weight Polyethylene). The slide surface 196 may interface with the support beam 120, permitting movement of the support beam 120 in the transverse direction y, for accommodating changes in the cover assembly 100 shape due to thermal and other environmental loads. Similarly to the above sealing arrangement discussion, the sealing gaskets 200 located on and along each side of the support beam 120 may abut against a backside 198 of the end cap angle 192 to form a seal for the panel 112.

It should also be mentioned that stiffening member 180 is terminated short of the end of support beam 120. By such a termination of the stiffening member 180, or any other stiffening member or members, only one size of support arrangement is necessary to accommodate a variety of cover assembly sizes. In the illustrative embodiment shown in FIG. 8, a connection angle 184 and mounting fasteners 186 are utilized to attach one end of stiffening member 180 to the vertical inner surface 406 of the wall 404 of the tank 400 thereby allowing some of the loading to be shared with the attachment at the top surface 402 of the wall 404. It should be noted that the particular end of the support beam 120 and stiffening member 180 shown in this figure is a fixed end attachment; in some embodiments, a sliding support shelf angle arrangement may be provided on the opposite end of the stiffening member 180 to attach to a vertical inner surface 406 of a wall 404 located on the opposite side of the tank 400, thereby allowing for movement due to thermal growth or other environmental cover stresses.

Figure 9A:
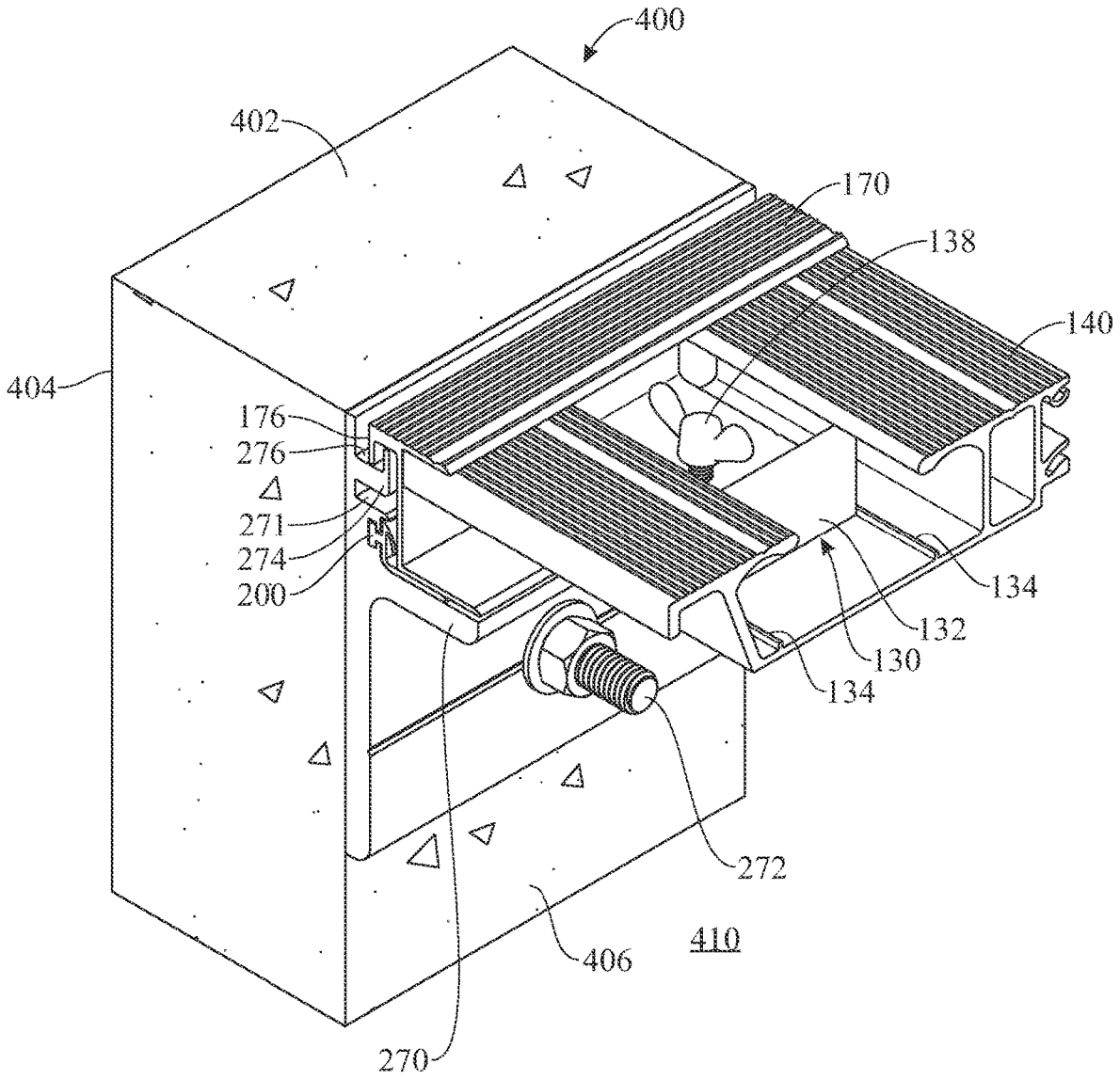
FIG. 9A presents a partial isometric view of a flush-mount cover support arrangement for a cover assembly, in accordance with an alternative embodiment of the invention.
Figure 9B:
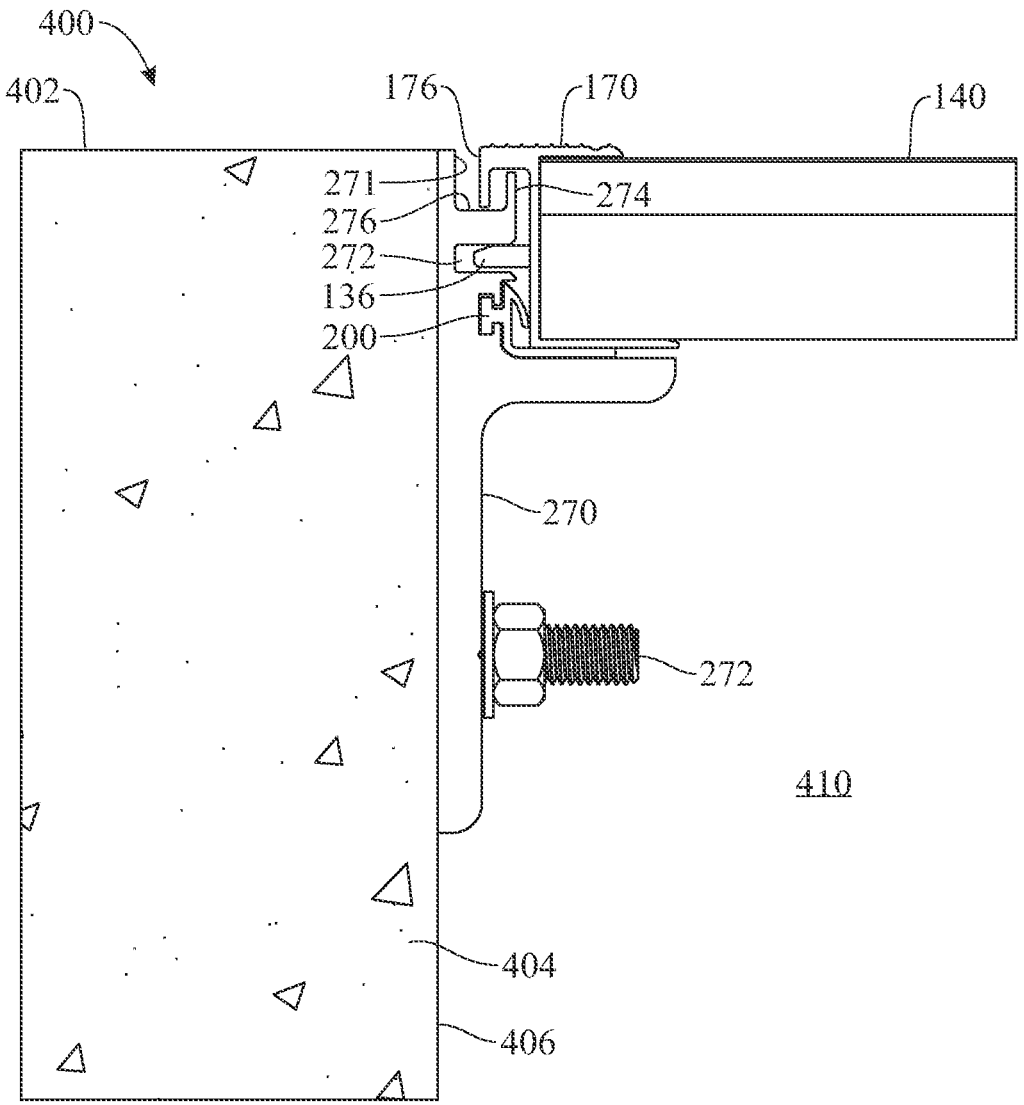
FIG. 9B presents a side elevation view of the flush-mount cover support arrangement of FIG. 9A.

The illustrations of FIGS. 9A and 9B show a partial perspective view and partial elevation view of an alternative embodiment illustrating a flush-mount cover support configuration for a cover assembly. For a cover deck surface to be level with the surrounding top surface 402 of the wall 404 of the tank 400, a flush mounting angle 270 or other type of shelf angle may be used. In the present embodiment, the flush mounting angle 270, which may be formed by extrusion, and preferably from aluminum, includes a retaining slot 271 that may have generally the same geometry and dimensions as the retaining slot 126 of the support beam 120 (FIG. 5). The retaining slot 271 of the flush mounting angle 270 is configured to receive the latch portion 136 of a slide latch assembly 130, and thus allows the slide latch assembly 130 to latch to the flush mounting angle 270, preventing the panels from any uplift or inadvertent disconnection therefrom. This flush-mount cover support configuration is different than the top mounting configuration discussed above with reference to FIGS. 7 and 8, and does not require unbolting the angles to remove the panel. Instead, the flush mounting angles 270 of the present figure may remain attached to the tank wall 404 when the panel is removed.

Continuing with the flush-mount cover support configuration shown in FIGS. 9A and 9B, the flush mounting angle 270 extends along the length of the wall 404 of the tank 400 and is attached thereto at intervals by mounting fasteners 272. The latch portion 136 of the slide latch assembly 130 engages the flush mounting angle retaining slot 271 as was heretofore described with reference to latching the slide latch assembly 130 to the support beam 120. In similar fashion to the interface between the interlock edge member 170 and the support beam 120 (FIGS. 4 and 5), the downward facing hook 176 of the interlock edge member 170 rests or sets down on a horizontal surface 276 of an upward facing hook 274 of the flush mounting angle 270. The downward facing hook 176 of interlock edge member 170 is preferably positioned at about a halfway location on the horizontal surface 276 of the flush mounting angle 270, as shown, allowing for thermal movement in either direction. A sealing gasket 200 is mounted between the interlock edge member 170 and the flush mounting angle 270, providing a seal therebetween in the same method as discussed heretofore for the seal with the support beam 120.

Figure 10A:
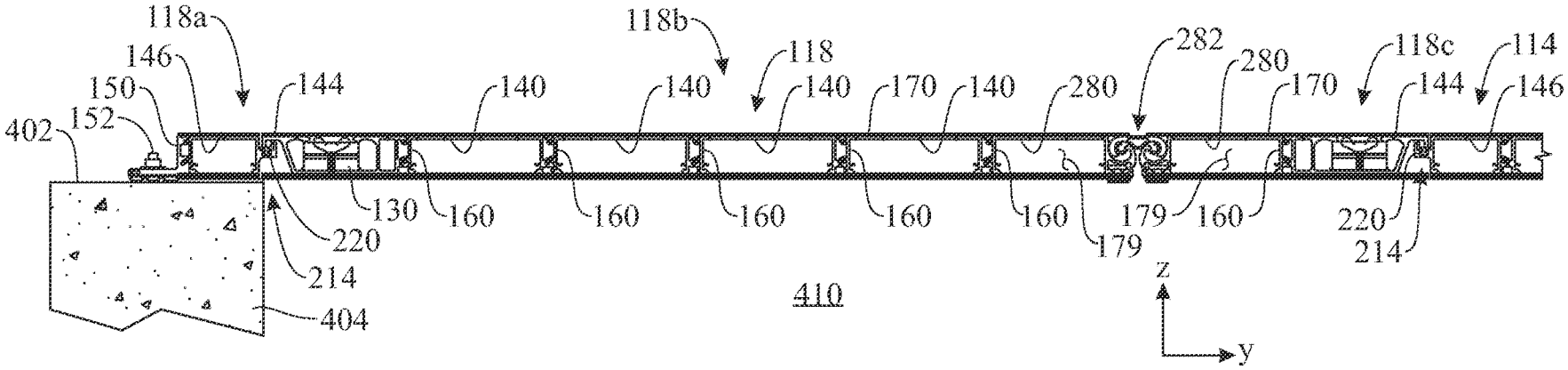
FIG. 10A presents a cross-sectional view, in accordance with section plane 10-10 of FIG. 1 illustrating a hinged access panel of the cover assembly of FIG. 1, the hinged access panel shown in a closed position.
Figure 10B:
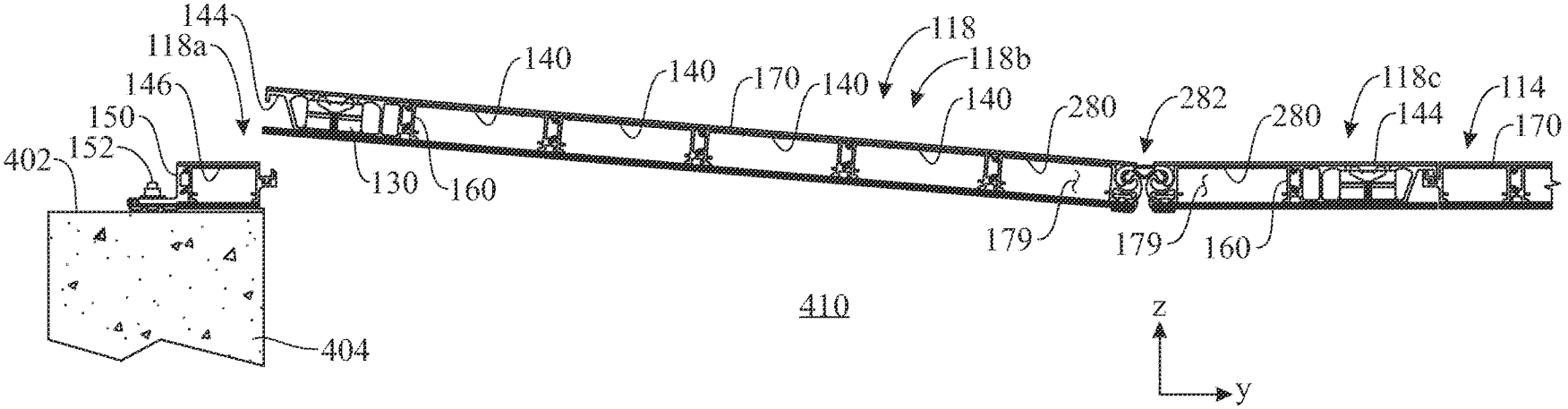
FIG. 10B presents a cross-sectional view of the hinged access panel cover assembly of FIG. 10A, illustrating the hinged access panel in a slightly opened position.

The hinged access panel 118 will now be described with reference to FIGS. 1, 10A and 10B, where FIGS. 10A and 10B show the hinged access panel 118 of the cover assembly 100 in a closed position and a slightly rotated open position, respectively. As shown in FIG. 1, hinged access panel 118 includes a plurality of planks 140 (and more particularly, four planks 140), which are arranged in back-to-back or adjacent relationship and are interconnected to one another by standard male-female connections 160. The hinged access panel 118 further includes a pair of hinge planks 280, which are hinged to one another, with a first one of the hinge planks 280 connected to the innermost plank 140 by a standard male-female connection 160. The hinge planks 280 are pivotably connected to one another by a hinge 282. This hinged arrangement enables the hinged access panel 118 to be an openable panel, thereby allowing access underneath the cover assembly 100, such as to access the interior space 410 of the hank 400. In preferred embodiments, the hinge 282 enables the panel hatch to fully open and close throughout a full 180° range of motion. In some embodiments, the hinge plank 280 may have a male and female version available that allow panels to be configured as necessary dependent upon the orientation of the standard male-female connection 160 on adjacent planks 140 or other plank-type components.

As further shown in FIGS. 10A and 10B, the hinged access panel 118 of the present embodiment is comprised of three distinct sections: a first panel section 118*a*, a second panel section 118*b* and a third panel section 118*c*. The first panel section 118*a* is a small section at an outer end of the hinged access panel 118 and is mounted to the top surface 402 of the wall 404 of the tank 400. The first panel section 118*a* may be constructed of one underlap plank 146 connected to one perimeter mounting angle 150 and may be attached to tank using mounting fasteners 152 in a similar method and spacing as discussed heretofore. A sealing gasket 240 as discussed hereinabove may be mounted below and along the perimeter mounting angle 150, providing an outside seal for the hinged access panel 118 against the tank 400. The second panel section 118*b* of the present embodiment constitutes the larger primary openable hinged access hatch of the hinged access panel 118. The second panel section 118*b* may include on one end an overlap plank 144 containing two slide latch assemblies 130 at opposite longitudinal ends thereof. The overlap plank 144 may be connected to the aforementioned series of four deck planks 140, which are followed by and connected to one of the hinge planks 280 as described heretofore. The third panel section 118*c*, in turn, is the remaining smaller openable access portion of the hinged access panel 118 on the hinge side opposite of the second panel section 118*b*. The third panel section 118*c* may include a hinge plank 280 and an overlap plank 144, interconnected to one another by a standard male-female connection 160. Two slide latch assemblies 130 are also installed within the overlap plank 144 of the third panel section 118*c*. At the overlap/underlap connection between the first and second panel sections 118*a* and 118*b*, and at the overlap/underlap connection between the third panel section 118*c* and the fixed, intermediate panel 114, a respective panel-to-panel sealing gasket 220 is mounted providing a sealing means as discussed heretofore.

With continued reference to FIGS. 10A and 10B, as mentioned heretofore, the hinged access panel 118 interconnects to an adjacent fixed panel 114. As stated above, the hinged access panel 118 includes hinge 282 allowing the second and third panel sections 118*b* and 118*c* to pivot relative to another. To open the second panel section 118*b*, the two slide latch assemblies 130 must first be disengaged near the interface with the first panel section 118*a*, allowing the second panel section 118*b* to subsequently rotate open in a clockwise direction while keeping the two slide latch assemblies 130 of the third panel section 118*c* engaged. In an alternative opening sequence, the two slide latch assemblies 130 near the interface between the first and second panel sections 118*a*, 118*b* may remain engaged while disengaging the two slide latch assemblies 130 located on the third panel section 118*c* to allow the third panel section 118*c* to rotate open in a counterclockwise direction relative to the second panel section 118*b*, while the second panel section 118*b* remains closed relative to the first panel section 118*a*. To remove the hinged access panel 118, both the second and third panel sections 118*b* and 118*c* can be removed as one piece along with the adjoining hinge 282 by disengaging all four slide latch assemblies 130 installed on the second and third panel sections 118*b* and 118*c* and lifting out the second and third panel sections 118*b* and 118*c*. Before lifting the second and third panel sections 118*b* and 118*c* from supporting members, the smaller, third panel section 118*c* is preferably fully rotated open 180° to sit on top of the second panel section 118*b* providing a more stable lifting arrangement, thereby eliminating the possibility of hinge swing. To remove the remaining, first panel section 118*a*, the mounting fasteners 152 holding down the perimeter mounting angles 150 are unbolted, and the first panel section 118*a* lifted from the wall 404 of the tank 400. During use of the cover assembly 100, however, the first panel section 118*a* may typically remain mounted and in place when panel sections 118*b* and 118*c* are being removed temporarily to gain access under the cover assembly 100. The removal of the first panel section 118*a* may be typically required for replacement or renovation of the cover assembly 100.

Similarly to the fixed cover panels described heretofore, the hinged access panel 118 may be comprised of extruded parallel deck planks 140 and other plank-like components, all of which are preferably interconnected edge-to-edge. The deck planks and other plank components of a hinged access panel 118 are held together by interlock edge members 170 extending across all plank component ends in the hinged access panel 118 as previously discussed. The interlock edge members 170 may have a C-shaped side 172 defining corresponding channel 174 for receiving the ends of the deck planks 140 thus supporting the deck planks from their ends and helping hold together the panel. The C-shaped side 172 and channel 174 may have tight tolerances providing for a firm, substantially gas-tight fit between deck planks 140 and other plank components and interlock edge members 170, although sealing material may be applied as joints are made if necessary. Such a seal may contribute to prepare the cover assembly 100 to serve, for instance, as a sewage treatment cover.

Figure 11A:
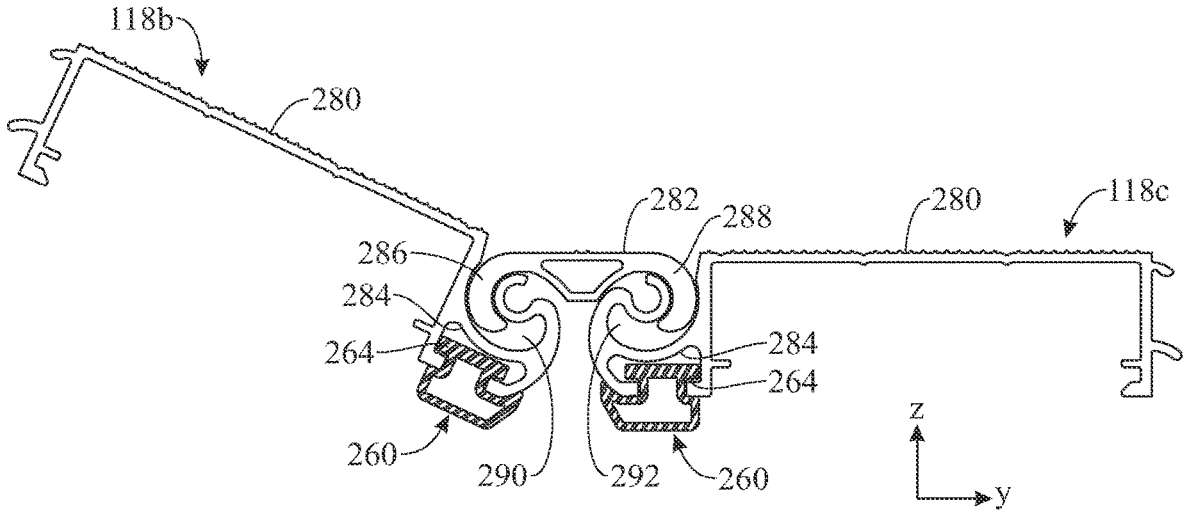
FIG. 11A presents a partially cross-sectional elevation view of the hinge used on the hinged access panel of FIGS. 10A and 10B, illustrating operation with mating hinge planks.
Figure 11B:
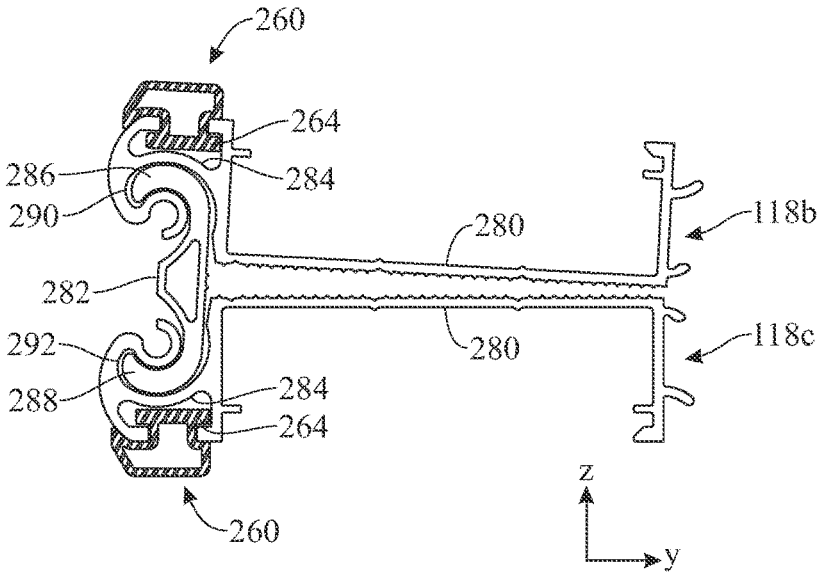
FIG. 11B presents a partially cross-sectional elevation view of the hinge of FIG. 11, rotated 92° to a fully open panel position.
Figure 12D:
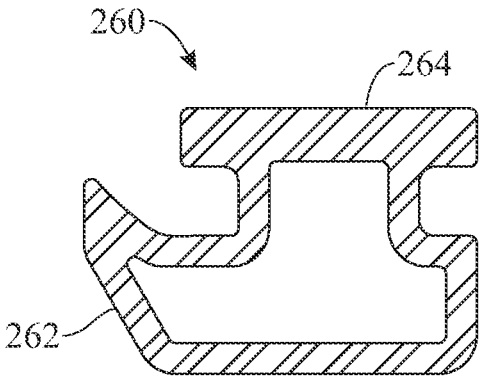
FIG. 12D presents an enlarged, cross-sectional elevation view of a sealing gasket used at hinge ends.

With continued reference to the hinged access panel 118, it should be noted that the interlock edge members 170 require their top portions of the C-shaped side 172 to be notched out around hinge 282 (refer to FIG. 1) enough to allow panel to freely rotate open and closed. An elastomeric sealing gasket 260 is provided on each end of the hinge planks 280 on each side of hinge 282 to allow the corners of panel sections 118*b* and 118*c* to seal against the sealing gaskets 200 that run perpendicular to the sealing gasket 260. As better shown in the enlarged view of FIG. 12D, the sealing gasket 260 may include a generally deformable main body 262, and a T-section 264 extending upward from the main body 262. The top T-section 264 of each sealing gasket 260 is slipped into a respective bottom opening 284 of each hinge plank 280 as shown in FIGS. 11A and 11B. A length of approximately 4 inches of the sealing gasket 260 may be sufficient at each end of the hinge plank 280 to provide a flexible seal with a substantially gas-tight seal at the corners of each panel located adjacent to hinge 282. Referring back to FIG. 10A, it should be noted that the vertical walls 179 of the interlock edge members 170 may extend past the longitudinal ends of hinge 282 to shield and prevent debris from getting into the hinge 282 and hindering operation.

Looking in more detail at the operation of hinge 282 and its mating with the hinge planks 280, attention is now directed to the partial views of second and third panel sections 118*b* and 118*c* of FIGS. 11A and 11B. As shown, the hinge 282 has a ram-horn shape, comprising two horns 286 and 288 located on each side of the hinge 282. The hinge 282 is installed into the hinge planks 280 by sliding the ram horns 286, 288 into corresponding curved slots 290 and 292 formed in the hinge planks 280. The hinge 282 is preferably configured such that, once inserted into the curved slots 290 and 292 of the hinge planks 280, the hinge 282 cannot be removed or dislodged. After installing the interlock edge members 170 onto the panel, the backside of the interlock edge members 170 retains the hinge 282 in place and does not allow the hinge 282 to slide out from the hinge planks 280. The hinge 282 may be conformed into an elongated, solid part, such as by extrusion, preferably of aluminum, allowing to increase durability and reliability of the hinge 282. Regarding the actual operation of hinge 282, shown in FIGS. 11A and 11B, it should be noted that, as the second panel section 118*b* is rotated clockwise to open, the hinge 282 may remain in a horizontal position. In preferred embodiments, the hinge 282 remains in the horizontal position until the second panel section 118*b* is rotated slightly over 92° (e.g., to approximately) 92° causing the left-side ram horn 286 to bottom out or abut against the end of the curved slot 290 of the hinge plank 280 on the second panel section 118*b*. Once the second panel section 118*b* reaches this position, further rotation of the second panel section 118 onto the third panel section 118*c* (clockwise, in the drawing), seeking to lay the second panel section 118*b* on top of the third panel section 118*c*, causes the hinge plank 280 of the second hinge section 118*b* pull clockwise on the end of the horn 286, causing the hinge 282 to start rotating clockwise. Responsively, the right-side ram horn 288 begins to travel clockwise further into the curved slot 292 of the hinge plank 280 of the third panel section 118*c*. Sufficient rotation of the second panel section 118*b* towards the third panel section 118*c* eventually causes the hinge 282 to reach the position shown in FIG. 11B, in which the second panel section 118*b* is opened and pivoted onto the third panel section 118*c*. It should be noted that, when the second and third panel sections 118*b* and 118*c* are closed (FIG. 10A), the hinge 282 may remain generally flush with the top of the panels 118, 114 thereby facilitating walking, standing and/or resting items, and contributing to prevent any type of trip hazard. In some embodiments, in the fully open position, the second panel section 118*b* and third panel section 118*c* may form an angle between 90° and 182° (FIG. 11B showing an example of the latter angle).

As also shown in FIG. 1, the hinge 282, as well as the hinge planks 280 may all have a length (dimension in the longitudinal direction x) generally equal to the length of the deck planks 140 and other plank-like components comprised in the hinged access panel 118. The hinge planks 280 may also be of the same width (dimension in the transverse direction y) as the deck planks 140. These configurations may enable the hinge planks 280 to be fully interchangeable with any plank and allow a hinge module (formed by hinge planks 280 and hinge 280) to be placed anywhere on the cover assembly 100 to form a hinged access panel 118. Furthermore, while the present embodiment includes a single hinged access panel 118, alternative embodiments may include two or more hinged access panels 118, or not include any hinged access panels 118.

In embodiments in which the parts forming a hinged access panel 118 are formed by extrusion, said parts are preferably extruded of aluminum. It will be evident to those familiar with the art that a hinged access panel can be provided in a cover assembly from materials such as wood or steel, and assembled using traditional welded or bolted connections. However, in preferred embodiments, the hinged access panel will be erectable at the location at which it is used, without the need for personnel having special skills; as such, and because of the efficient operation of a one piece extruded hinge, it is particularly advantageous to use lightweight components of the present invention that require no welds and with few or no bolted connections to assemble a hinged access panel.

Figure 13:
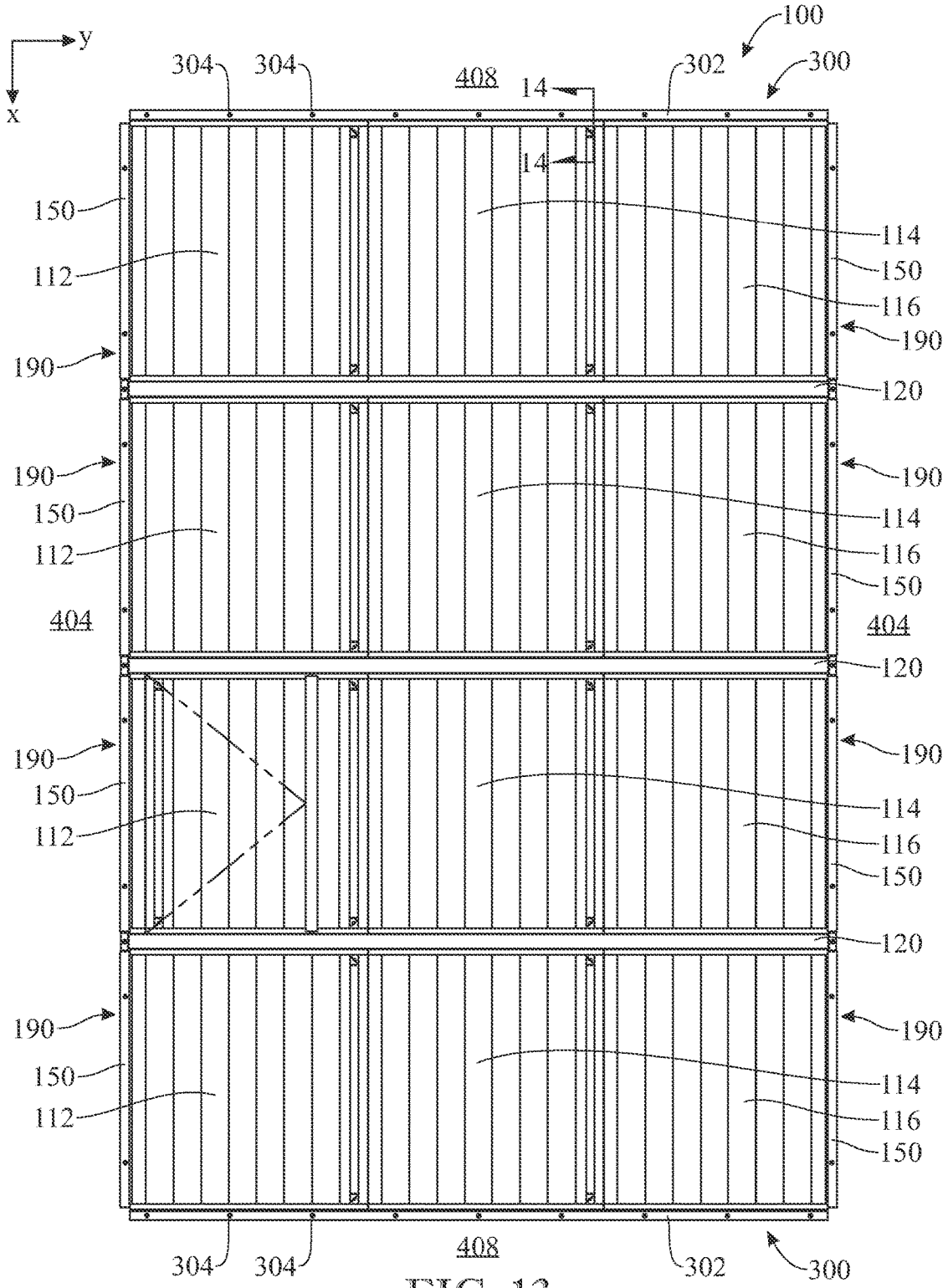
FIG. 13 presents a top plan view of the cover assembly of FIG. 1, including perimeter panels not shown in FIG. 1.

The illustration of FIG. 13 shows a method of completing the ends of the rectangular cover assembly 100 shown in FIG. 1. Here, the cover assembly 100 includes three bays or columns of panels each consisting of four panels each. One bay consists of three panels 112 and one hinged access panel 118. The second bay consists of four panels 114 while the third bay consists of four panels 116. Panels 112, 116 and 118 are perimeter located panels referred to as end panels, with one edge of panel being supported on opposite tank walls 404 (opposite to one another along the transverse direction y) and having a top mount support arrangement 190 that has been previously discussed with reference to FIGS. 2 and 7. As shown in FIG. 13, the remaining six outer longitudinal ends extend and are mounted to tank walls 408, the walls 408 arranged at opposite longitudinal ends of the cover assembly 100 and extending in the transverse direction y between the longitudinal walls 404.

Figure 14:
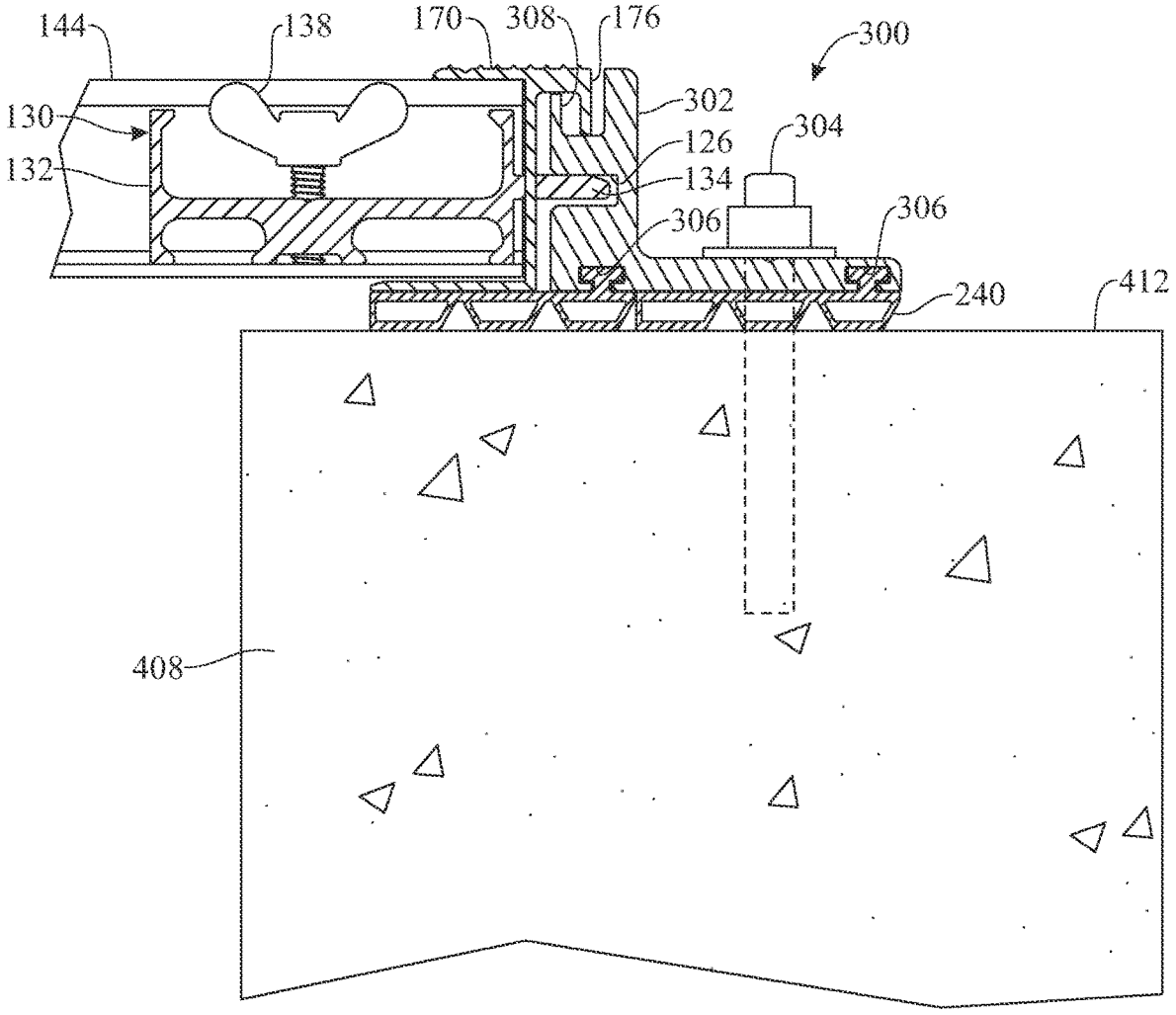
FIG. 14 presents a cross-sectional side elevation view of a panel edge, in accordance with section plane 14-14 of FIG. 13, illustrating one embodiment of the top-mount perimeter sealing arrangement of the cover assembly of FIG. 13.

The illustration of FIG. 14 shows a preferred embodiment of a top mount support arrangement 300 for connecting the outer longitudinal ends of the panels with each transverse wall 408. The top mount support arrangement 300 includes interlock angles 302 extending in the transverse direction y along a top surface 412 of the walls 408 of the tank 400 and attached thereto at intervals by mounting fasteners 304. Unlike the perimeter mounting angles 150 along walls 404 that are interrupted at each support beam 120, as best shown in FIGS. 1 and 13, the interlock angles 302 of FIGS. 13 and 14 may run continuously along the perimeter panels 112, 114 and 116 along the top surface 412 of the transverse walls 408 of the tank 400 therefore spanning all three panels. In some embodiments, such as for spans longer than 50 feet, interlock angles 302 may be split at convenient locations to meet shipping requirements and mounted in the field in consecutive and abutting relationship with one another. The interlock angle 302 may be similar to the support beam 120 in that it is used for securing panels with the use of slide latch assemblies 130 and may have the same dimensional geometry incorporated into the extrusion with a hooked connection at the top (between an upward hook 308 of the interlock angle 302 and the downward hook 176 of the interlock edge member 170), and with the retaining slot 126 to function with the latch portion 136 of the slide latch assembly 130. One or more perimeter cover-to-tank sealing gaskets 240 may be mounted between each interlock angle 302 and the top surface 412 of the tank wall 408 to form a substantially gas-tight seal at the perimeter panel-to-tank interface. More specifically, in preferred embodiments, such as the present embodiment, there may be two perimeter sealing gaskets 240 mounted between each interlock angle 302 and the top surface 412 of the tank wall 408; each sealing gasket 240 may be mounted to a respective T-slot 306 of a pair of T-slots 306 formed in the interlock angle 302. The perimeter sealing gaskets 240 may run under the entire interlock angle and continue out under panel 114 to form a gas-tight seal along the interlock edge member 170. In preferred embodiments, the perimeter sealing gaskets 240 may be arranged in parallel relationship and/or against one another, and preferably, both parallel to and in contact with one another.

Figure 15:
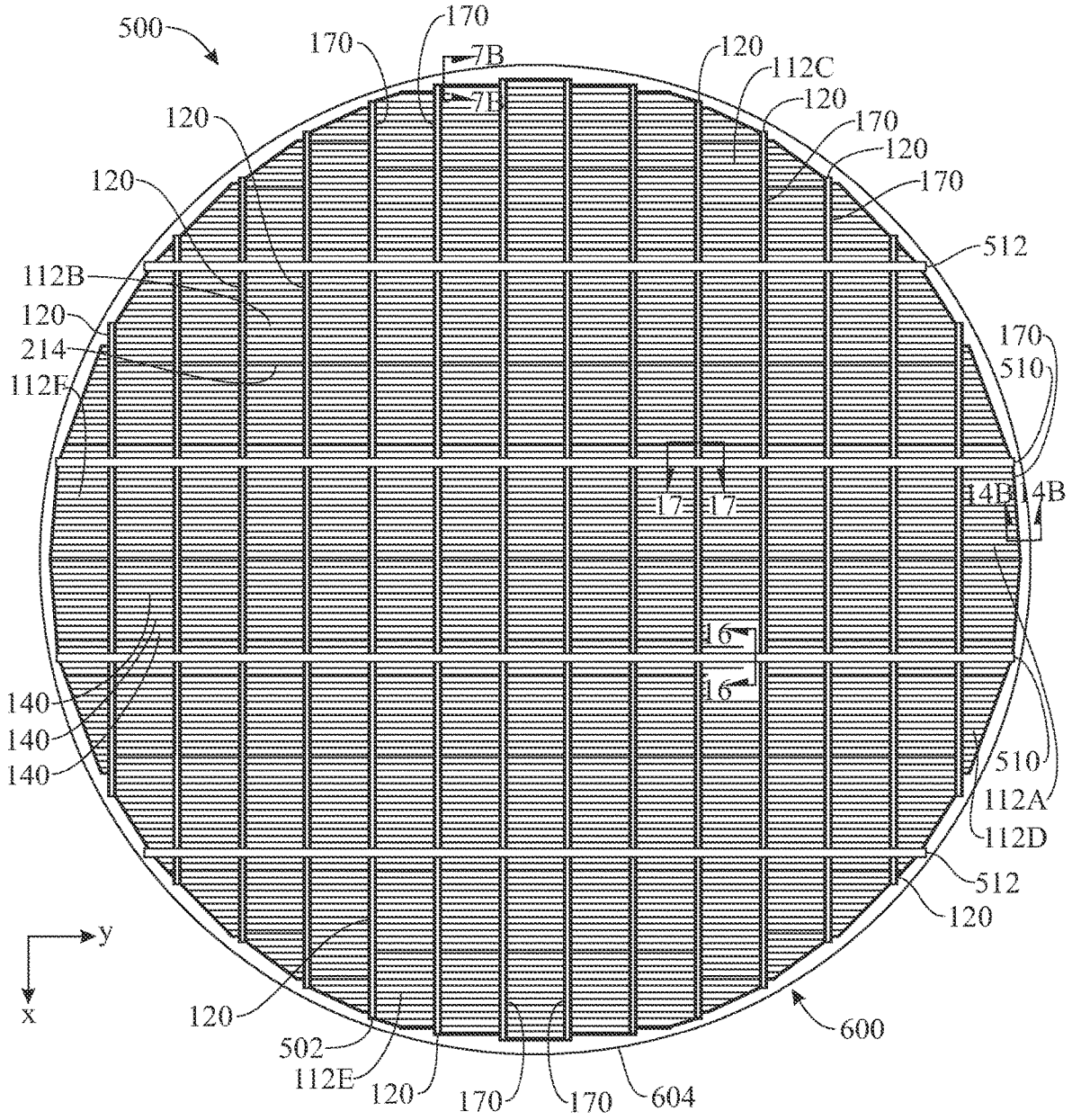
FIG. 15 presents a top plan view of a circular cover assembly in accordance with another illustrative embodiment of the present invention.

With reference now to FIG. 15, a cover assembly 500 is illustrated in accordance with a further embodiment of the invention. As shown, unlike the previous embodiments, the cover assembly 500 of the present embodiment is circular. In preferred implementations, the circular cover assembly 500 is configured to be secured to the tank by a top mount system. In the example shown in the drawing, the cover assembly 500 includes a large number of interior panels (for example, panels 112B and 112C) that are not located at the edges of the cover assembly 100, and have a rectangular shape and different panel dimensions depending on their location on the cover assembly 500. Interior panels 112B make up the majority of the interior panels on the cover assembly 500, and thus may be considered a "standard" panel. Remaining interior panels may be of differing rectangular sizes to further form the circular shape of the cover assembly 500. In addition, the cover assembly 500 includes perimeter panels (for example, panels 112D, 112E and 112F), each perimeter panel having an outer arched contour (i.e. an outer contour in the form of a portion of a circle), the outer arched contour corresponding to a circle having generally the same diameter as the cover assembly 500 or tank. The perimeter panels come in various sizes and with different circular arcs such that, when assembled, a generally full circle or circular outer contour is formed. When all interior and exterior panels are assembled, the covered ends of the perimeter panels lie generally in a circle having about the same diameter as the cover assembly 500 or tank.

The interior rectangular panels, including panels 112B and 112C, have two generally parallel straight sides, arranged in longitudinal direction x, which interconnect to support beams 120 (refer to FIGS. 4 and 5 for details on construction). The remaining two parallel sides, arranged in the transverse direction y, have an overlap/underlap connection 214 on one side as previously discussed with reference to FIG. 6 and the other side interfacing with a top mounted truss support system which helps support the large diameter, circular cover assembly 500. The top mounted truss system may include, for instance, four trusses 510, 512, and associated cross bracing configured to support the circular cover assembly 500. The four trusses 510, 512 may more specifically consist of two longer trusses 510 and two shorter trusses 512. The connection between the panels and the trusses is discussed in detail hereinbelow.

The perimeter panels, such as panels 112D, 112E and 112F, may include one or two longitudinal straight sides that connect to a respective support beam 120 with the same connection method as discussed for rectangular cover assembly 100. For some perimeter panels (see, for instance, panel 112E), on one of the longitudinal sides connecting to a support beam 120, the support beam 120 may terminate on the wall 604 of the tank 600 at a termination point 502, after which the panel 112E may continue in an arched or angled panel side that sits on the wall 604 and provides a segment of the circular outer contour of the cover assembly 500. In other instances, a perimeter panel may be generally triangularly-shaped, as shown for instance with panel 112D.

In accordance with the present disclosure, circular covers may be supported in the same manner as rectangular covers, with the loading supported at least partially by the support beams 120 and optional stiffening members. In the present embodiment, the loads from the support beams 120 (and thus the weight of the cover assembly 500) is carried into the truss system and the structure of the tank 600. In preferred embodiments, the panels for the circular cover assembly 500 may be constructed with the same edge-to-edge deck construction as described heretofore, using deck planks 140 and other plank-like components such as overlap planks 144.

A grid-like support pattern similar to the one used for rectangular cover assembly 100 is also used on the circular cover assembly 500 of the present embodiment, with the only difference being that perimeter members are generally positioned at angles rather than being exclusively longitudinal or transversal as with the rectangular cover. In preferred embodiments, the perimeter panel edges are straight chord sections and not a rolled circular shape thereby allowing for use of the same mounting methods as with the rectangular tank. For example, a cross-sectional view in accordance with section plane 7B-7B of FIG. 15 would reveal the same mounting configuration as shown in and described with reference to FIG. 7 for the rectangular tank. In turn, a cross-sectional view in accordance with section plane 14B-14B of FIG. 15, where the interlock edge member 170 forms the perimeter of panel 112A, would reveal the mounting configuration using interlock angle 302 as shown in and described with reference to FIG. 14. Both the interlock angle 302 and interlock edge member 170 are not perpendicular to the deck planks 140 and other plank-like components, but instead are at a slight angle to adapt to mounting to the circular tank wall 604. It should be pointed out that, in this panel configuration, the deck planks 140 and other plank-like components are generally of different lengths, with the outside perimeter ends of plank components being angled to mate with both the interlock edge member 170 and the interlock angle 302. Sealing gaskets 240 and mounting fasteners 304 may be used to provide a substantially gas-tight seal and secure panel 112A to the tank wall 604. As was the case with the rectangular tank mounting, the mounting arrangement for FIG. 14 may be constructed in fixed or sliding configurations as necessary.

The two mounting arrangements shown in FIGS. 7 and 14 and described above are intended to illustrate some preferred mounting embodiments that may be utilized for circular cover assemblies, but by no means are they the only mountings that apply and shall not be understood limit the scope of the present invention.

Figure 16:
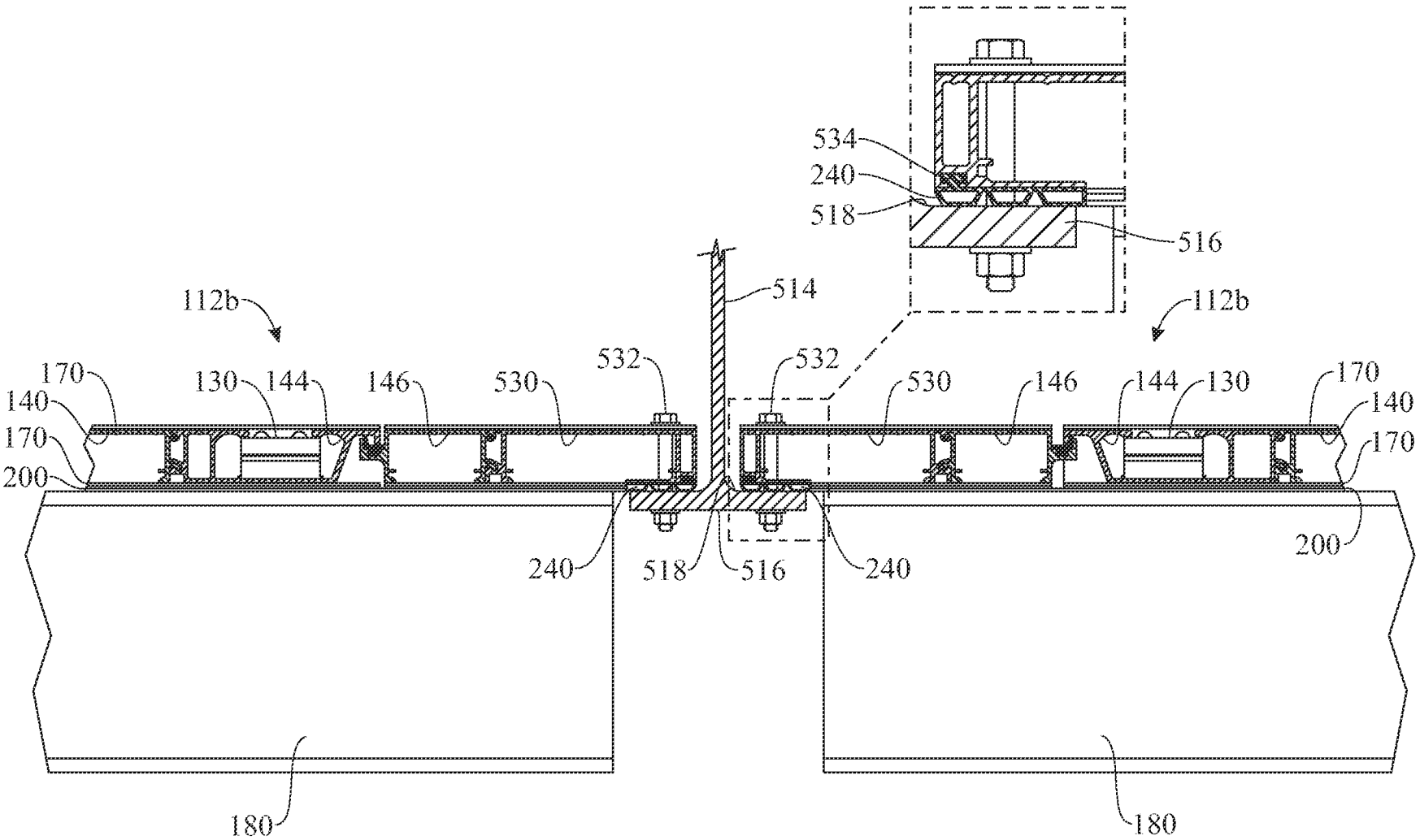
FIG. 16 presents a cross-sectional elevation view, in accordance with section plane 16-16 of FIG. 15, illustrating a cover support arrangement for the circular cover assembly of FIG. 15.
Figure 17:
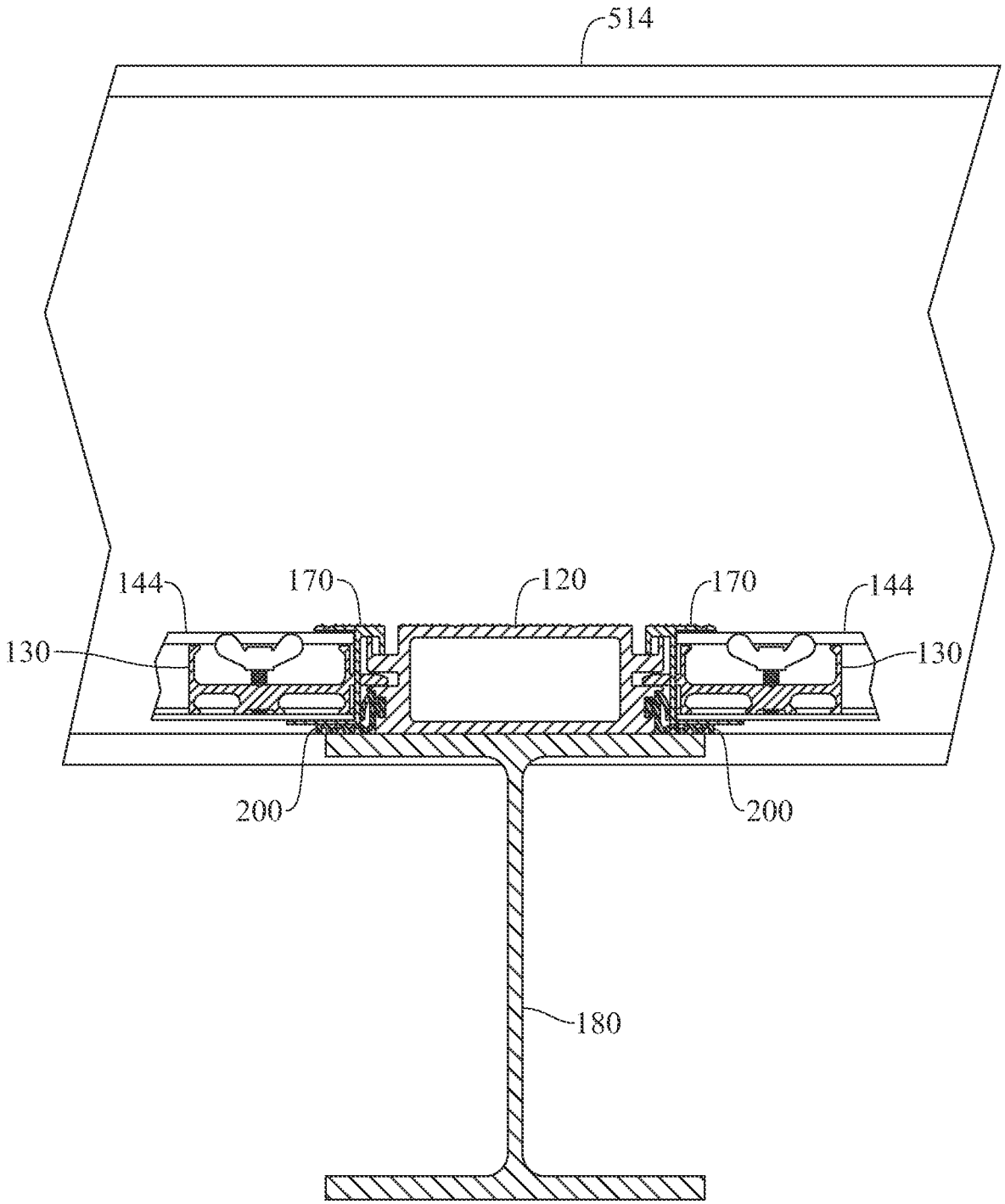
FIG. 17 presents a cross-sectional elevation view, in accordance with section plane 17-17 of FIG. 15, illustrating a sealing arrangement for a panel of the circular cover assembly of FIG. 15.

Referring again to FIG. 15 and as noted hereinabove, some panels of the circular cover assembly 500 may be supported at least partially by the top mounted support trusses 510 and 512. In this regard, the illustration of FIG. 16 shows a cross-sectional side elevation view illustrating the attachment of two adjacent intermediate panels 112B to a lower truss chord member 514 of truss 512. It should be noted that panel connections at truss 510 may be the same as those discussed herein with reference to truss 512. As shown in FIG. 16, panels 112B may sit atop an inner side 518 of a bottom flange 516 of the lower truss chord member 514. Each panel 112B may have a respective end plank 530 at the end of panel 112B. The end planks 530 may be attached to the bottom flange 516 of the lower truss chord member 514 using fastening bolts 532 arranged at discrete intervals along edge of panel 112B. A respective, perimeter sealing gasket 240 located in a T-slot 534 of each end plank 530 provides a substantially gas-tight seal between bottom edge of each respective panel 112B and the inner side 518 of the truss chord bottom flange 516. The illustration of FIG. 17 shows a cross-sectional rear elevation view, along a section plane perpendicular to that of FIG. 16, and also perpendicular to the support beam 120 and the stiffening member 180 that form the longitudinal sides of panels 112B discussed with reference to FIG. 16. The same connection and sealing methods discussed previously with reference to FIGS. 4 and 5 may be used in the connection shown in FIG. 17.

Figure 18:
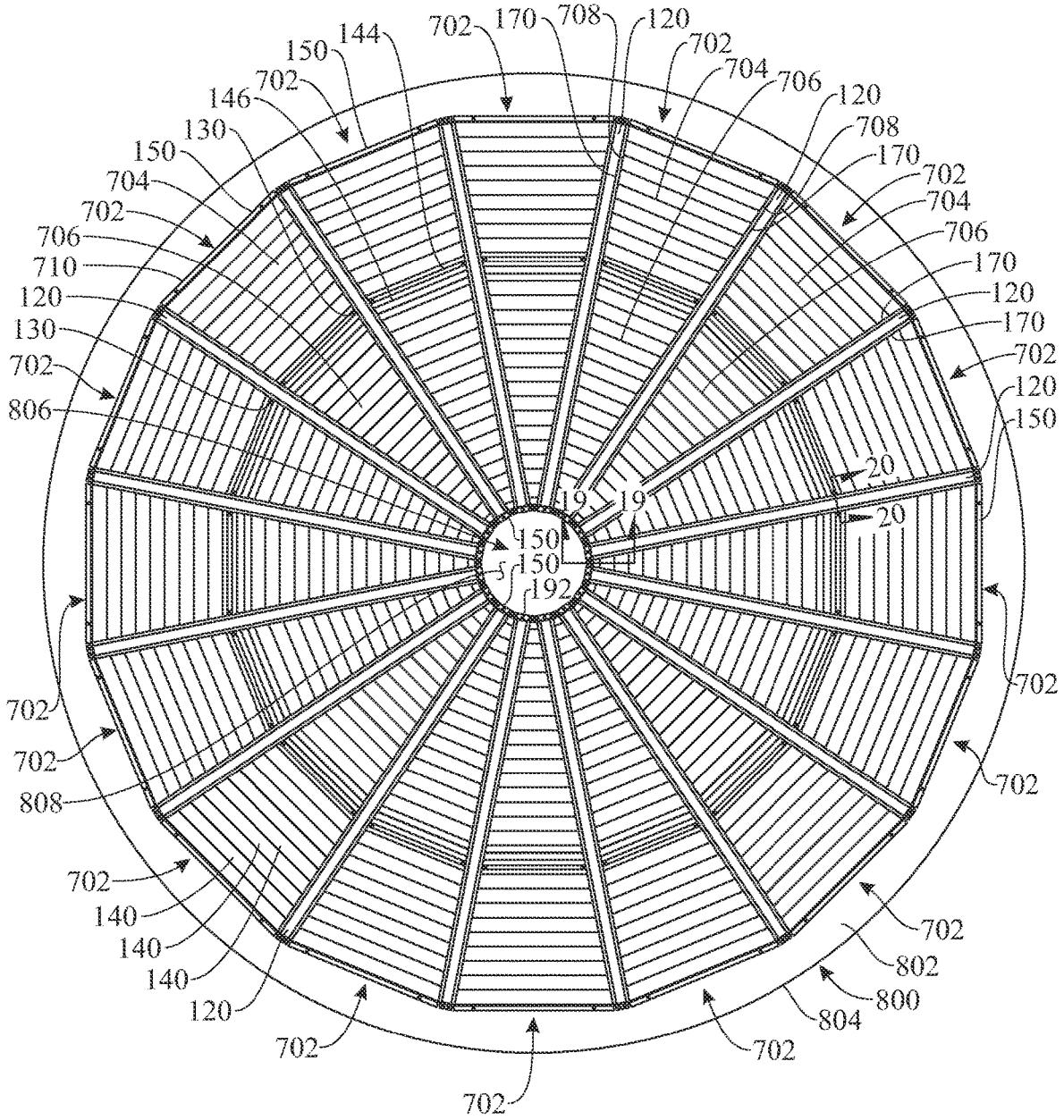
FIG. 18 presents a top plan view of a circular cover in accordance yet another embodiment of the present invention.

A further preferred embodiment of a circular flat panel cover assembly is illustrated in FIG. 18, shown installed on an outer wall 804 of a tank 800, wherein both the tank 800 and the outer wall 804 are generally circular. The circular cover assembly 700 of the present embodiment includes a plurality of pie-shaped panel sections 702, each pie-shaped panel section 702 generally having the shape of an angular portion of a circle with about the same diameter as the cover assembly 700. Each pie-shaped panel section 702 is comprised of a perimeter panel 704 and an interior panel 706, and is separated from adjacent pie-shaped panel sections 702 by radially positioned support beams 120. The pie-shaped panel sections 702 and support beams 120 are arranged alternately and in a radially outward configuration as shown in the top plan view of FIG. 18. The perimeter and interior panels 704 and 706 forming each pie-shaped panel section 702 are located between a pair of adjacent radial support beams 120 and attached thereto via interlock edge members 170, as discussed heretofore for rectangular cover assemblies. Hinged access panels, which may be constructed as was heretofore described with reference to hinged access panel 118, may also be incorporated into the circular cover assembly 700 in some embodiments.

With continued reference to FIG. 18, each panel 704 and 706 has two straight sides 708 arranged radially. Along each straight side 708, an interlock edge member 170 connects the panel 704, 706 to a corresponding support beam 120. As with the previous embodiments, the panels 704 and 706 may be mainly constructed of deck planks 140 and other plank/like components, which are arranged generally transverse relative to radial directions of the circular cover assembly 700. The deck planks 140 and other plank-like components forming panels 704 and 706 are angled at each end to mate with the radially oriented, interlock edge members 170 and support beams 120. Each perimeter panel 704 has an outer or perimeter, straight side 710 at the outer wall 804 of the tank 800; at the straight side 710, the panel 704 comprises a perimeter mounting angle 150 connecting the panel 704 to the wall 604 of the tank 800. On an opposite, inner end of the panel 704 is an overlap plank 144, parallel to the interlock mounting angle 150. Two slide latch assemblies 130 to connect the panel 704 to the support beam 120. Each interior panel 706, in turn, has a straight side at an outer edge of the panel, the straight side provided by an underlap plank 146 terminating the interior panel 706. The underlap plank 146 is held down by an overlap connection of panel 704 onto the underlap plank 146. On the apex side of the interior panel 706, near a center hub 806 of the circular tank 800, is a perimeter mounting angle 150 that is anchored to a top surface 808 of the center hub 806.

Figure 19:
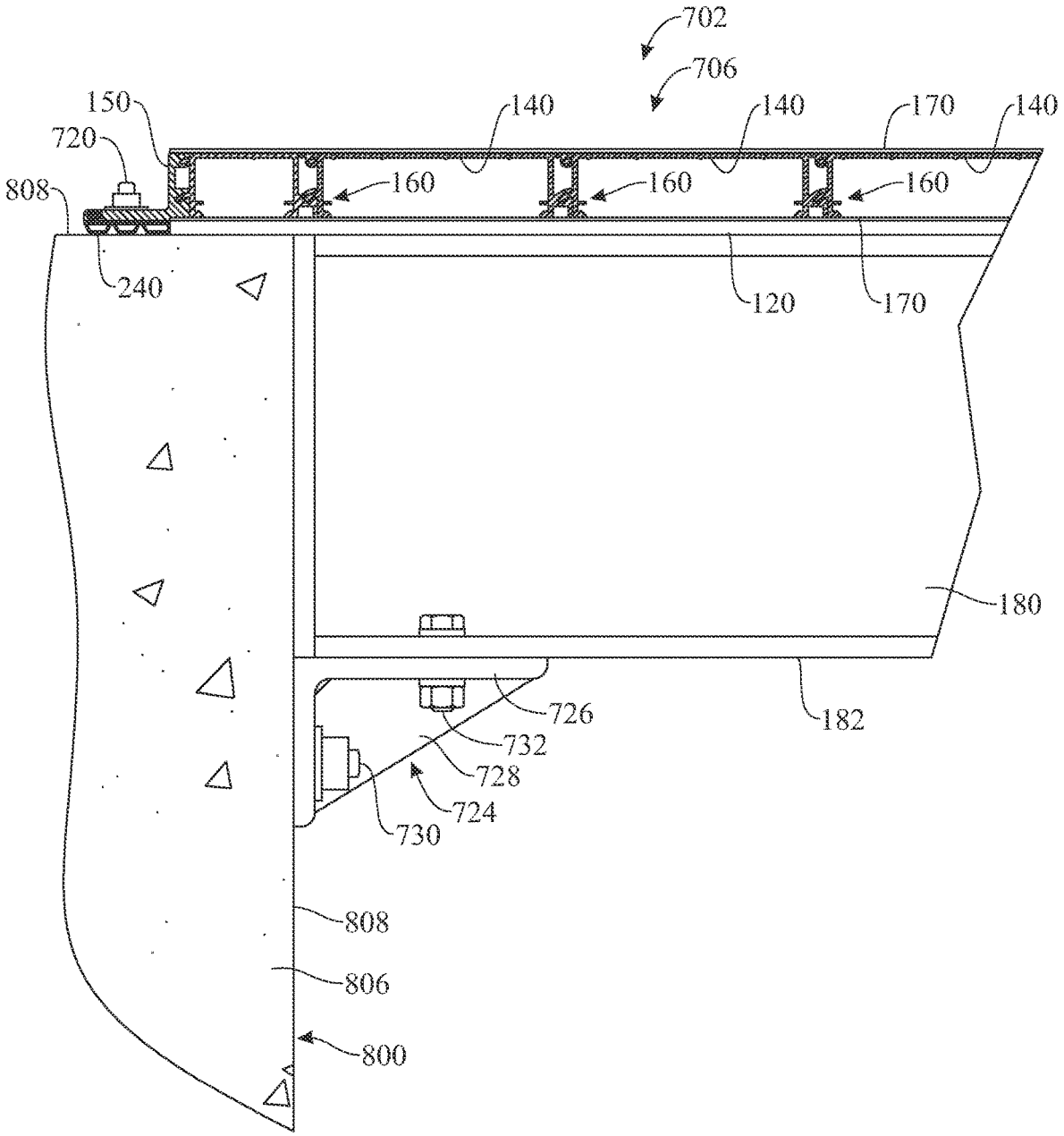
FIG. 19 presents a cross-sectional elevation view, in accordance with section plane 19-19 of FIG. 18, illustrating a cover support means and sealing method for the circular cover assembly of FIG. 18.

The cross-sectional view of FIG. 19 shows an illustrative mounting of the interior panel 706 to the top surface 808 of the center hub 806. As shown, the perimeter mounting angle 150 may be secured to the top surface 808 of the center hub 806 using mounting fasteners 720. In this example, this innermost end of the interior panel 706 is rigidly or fixedly supported; in turn, the outer perimeter mounting angle 150 located on the outside edge of the exterior panel 704 of the same panel section 702 as the interior panel 706, at the top surface 802 of the tank wall 604, may have a sliding configuration to accommodate thermal movement of the cover assembly 700. A perimeter cover-to-tank sealing gasket 240 provides a substantially gas-tight seal for the panel at the tank/cover interface. In this particular example, a shelf angle arrangement 724 is used to support the stiffening member 180 that is located underneath the support beam 120 to meet a specific span requirement. The shelf angle arrangement 724 comprises a shelf angle 726 and a stiffening plate 728 and is used to support the built-up panel section 702. The shelf angle arrangement 724 is anchored to a vertical wall surface 808 of the center hub 806 of the circular tank 800 using mounting fasteners 730. During or prior to installation, the shelf angle 726 is rolled to the required radius to conform to the curvature of the vertical wall surface 810 of the center hub 806. As stated hereinabove, this innermost end of the panel section 702 is a fixed end, and includes mounting bolts or fasteners 732 to attach the shelf angle arrangement 724 to the bottom surface 182 of the stiffening member 180 as shown in FIG. 19. In turn, at an opposite end of the support beam 120 and stiffening member 180, a sliding connection may be provided between the panel section 702 at the top surface 802 of the outer wall 804 of the tank 800.

Figure 20:
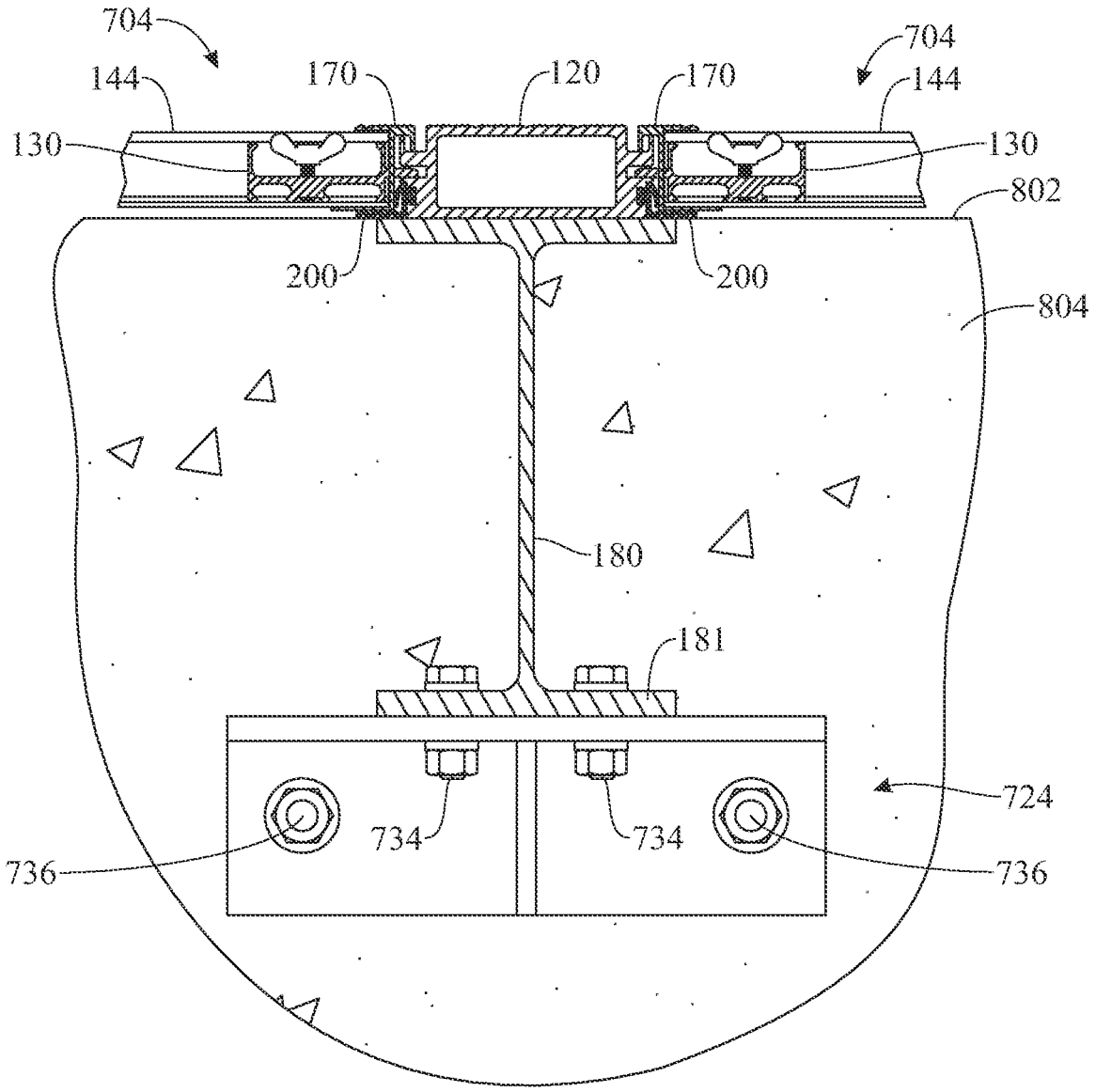
FIG. 20 presents a cross-sectional elevation, in accordance with section plane 20-20 of FIG. 18 schematically illustrating a cover support means and sealing method for the circular cover assembly of FIG. 18.

The illustration of FIG. 20 shows a cross-sectional elevation view of a similar shelf angle arrangement 724 at the outer wall 804 of the tank 800. As shown, the stiffening member 180 is attached to the shelf angle arrangement 724 using mounting fasteners or bolts 734, which may extend through openings formed through the bottom flange 181 of the stiffening member 180. The slots may be elongately formed in the radial direction providing the aforementioned sliding connection or capability at the outer wall 804 of the tank 800. Furthermore, the shelf angle 726 is mounted to an inside vertical surface of the tank wall 804 using wall anchors or mounting fasteners 736 as shown. A gas-tight sealing may be achieved between the panels 704 and the support beam 120 using sealing gaskets 200 as previously discussed.

It should be noted that the general construction method for both rectangular covers and circular covers is essentially the same. Deck planks 140 and other plank-like components being used to build panels, and the same interlock edge members 170 being used on plank ends to hold the panels together. The panels for both rectangular and circular covers are secured to support beams 120. The main difference between the rectangular cover assembly and circular cover assembly is the shape of individual panels. Rectangular covers generally have rectangular shaped panels while circular covers can have different shaped panels as shown in FIGS. 15 and 18, the shape of the panels depending, for instance, on how the support beams 120 are positioned within the cover (either radially or in a grid-like manner) and on the location of the panels. It should be noted that alternative cover assembly shapes are further contemplated and may be constructed without departing from the scope of the present disclosure.

The embodiments described herein are intended to illustrate the principles of the invention, but not to limit its scope. Other embodiments and variations to these embodiments will be apparent to those skilled in the art and may be made without departing from the spirit and scope of the invention as defined.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A cover assembly for covering an enclosure, comprising:

a plurality of support beams;

a plurality of elongated, interlock edge members; and a plurality of planks, each plank of the plurality of planks elongately formed along a longitudinal direction, the plurality of planks mountable to each other in groups, each group containing a respective, selectable number of planks of the plurality of planks arranged in side-by-side, parallel relationship and connected to one another to form a respective panel, such that a plurality of panels is formed by mounting each group of planks, wherein each panel of the plurality of panels has opposite longitudinal ends respectively defined by opposite longitudinal ends of the planks forming said each panel, said longitudinal ends of the planks interconnected at each longitudinal end of said each panel by a first connection between a respective interlock edge member of the plurality of interlock edge members and said longitudinal ends of the planks; wherein the cover assembly is configured to adopt an assembled configuration in which the cover assembly is positioned over an opening of an enclosure and a perimeter of the cover assembly is gas-tightly mounted to the enclosure, and the cover assembly gas-tightly encloses an interior space of the enclosure which is in fluid communication with the opening, and further in which:

the plurality of support beams is mounted over the opening, with each support beam mounted at opposite ends thereof to the enclosure, and the plurality of panels is positioned over the opening to at least partially cover the opening, with at least one of the longitudinal ends of each panel of the plurality of panels gas-tightly connected to a corresponding support beam of the plurality of support beams by a second connection formed by a downward hook member of the respective interlock edge member of said at least one of the longitudinal ends of said each panel being hooked over and vertically downward onto an upward hook member of said corresponding support beam, such that said each panel is supported on the corresponding support beam, wherein the first connection is independent from the second connection.

2. The cover assembly of claim 1, wherein, in the assembled configuration, a subset of panels of the plurality of panels is arranged at the perimeter of the cover assembly, with one of the longitudinal ends of each panel of the subset of panels gas-tightly connected to the corresponding support beam of the plurality of support beams and the other of the longitudinal ends of said each panel of the subset of panels gas-tightly connected to the enclosure such that said each panel of the subset of panels is supported on the enclosure and on said corresponding support beam.

3. The cover assembly of claim 2, further comprising a plurality of latch assemblies, wherein, in the assembled configuration, said each panel of the subset of panels is disconnectably secured to the corresponding support beam and to the enclosure by one or more latch assemblies of the plurality of latch assemblies disconnectably latching said one of the longitudinal ends of said each panel to the corresponding support beam and by one or more additional latch assemblies of the plurality of latch assemblies disconnectably latching said other of the longitudinal ends of said each panel to the enclosure.

4. The cover assembly of claim 1, wherein, in the assembled configuration, a subset of panels of the plurality of panels is not arranged at the perimeter of the cover assembly, and both longitudinal ends of each panel of the subset of panels are gas-tightly connected to respective, corresponding support beams of the plurality of support beams such that said each panel of the subset of panels is supported on the corresponding support beams.

5. The cover assembly of claim 4, further comprising a plurality of latch assemblies, wherein, in the assembled configuration, said each panel of the subset of panels is disconnectably secured to the corresponding support beams by one or more latch assemblies of the plurality of latch assemblies disconnectably latching each one of the longitudinal ends of said each panel to the respective, corresponding support beam.

6. The cover assembly of claim 1, wherein the plurality of planks are generally flat on a top side thereof, and further wherein, in the assembled configuration of the cover assembly, the top sides of the plurality of planks forming the plurality of panels positioned over the opening of the enclosure jointly provide a stable top deck surface.

7. The cover assembly of claim 1, wherein the plurality of planks are interchangeably connectable to each other by a male-female connection.

8. The cover assembly of claim 1, wherein, in the assembled configuration, adjacent panels may be transversely coupled to one another by an edge plank of the plurality of planks of one of the adjacent panels overlapping and coupling with an adjacent edge plank of the plurality of planks of the other of the adjacent panels.

9. The cover assembly of claim 8, wherein the edge plank of said one of the adjacent panels comprises an elongated, downward hook member and the edge plank of said other of the adjacent panels comprises an elongated, upward hook member, wherein, in the assembled configuration of the cover assembly, the downward hook member is hooked over and vertically downward onto the upward hook member and is movable transversely with respect to the upward hook member enabling an adjustment of a transverse position of said adjacent panels relative to one another.

10. The cover assembly of claim 8, wherein, in the assembled configuration, the edge plank of said one of the adjacent panels is latched to the corresponding support beam by a latching mechanism.

11. The cover assembly of claim 1, wherein a hinge panel of the plurality of panels comprises an elongated, hinge member having opposite first and second sides rotatably coupled to one another about a longitudinal rotation axis, wherein the opposite first and second sides of the hinge member are attached to respective, adjacent planks of the group of planks forming said hinge panel enabling a first portion of the panel on the first side of the hinge member to with respect to a second portion of the panel on the second side of the hinge member about the longitudinal rotation axis, and further wherein, in the assembled configuration of the cover assembly, the first portion of the panel is pivotable by the hinge member between an open position and a closed position allowing and preventing access to the interior space through the opening, respectively.

12. The cover assembly of claim 1, further comprising at least one stiffening member, wherein, in the assembled configuration of the cover assembly, the at least one stiffening member is mounted to the enclosure and spans across the opening, the at least one stiffening member supporting one or more support beams of the plurality of support beams.

13. The cover assembly of claim 1, wherein the plurality of interlock edge members are formed by extrusion.

14. The cover assembly of claim 1, wherein each interlock edge member of the plurality of interlock edge members comprises an elongated, C-shaped side, the C-shaped side defining an elongated channel configured to receive and couple with either one of the longitudinal ends of a panel of the plurality of panels in the assembled configuration of the cover assembly.

15. The cover assembly of claim 1, wherein, in the assembled configuration, the downward hook member is transversely movable with respect to the upward hook member.

16. The cover assembly of claim 1, wherein, in the assembled configuration, the downward hook member is longitudinally movable with respect to the upward hook member.

* * * * *